US011572721B2

(12) United States Patent
Strole et al.

(10) Patent No.: US 11,572,721 B2
(45) Date of Patent: Feb. 7, 2023

(54) LATCH ASSEMBLY

(71) Applicant: STRATTEC SECURITY CORPORATION, Milwaukee, WI (US)

(72) Inventors: Michael Strole, Royal Oak, MI (US); Ian Martin, Waterford, MI (US)

(73) Assignee: STRATTEC SECURITY CORPORATION, Milwaukee, WI (US)

( * ) Notice: Subject to any disclaimer, the term of this patent is extended or adjusted under 35 U.S.C. 154(b) by 337 days.

(21) Appl. No.: 16/738,445

(22) Filed: Jan. 9, 2020

(65) Prior Publication Data

US 2020/0232263 A1 Jul. 23, 2020

Related U.S. Application Data

(60) Provisional application No. 62/793,682, filed on Jan. 17, 2019.

(51) Int. Cl.

| | |
|---|---|
| ***E05B 81/20*** | (2014.01) |
| ***E05B 83/24*** | (2014.01) |
| ***E05C 3/00*** | (2006.01) |
| ***E05C 3/12*** | (2006.01) |

(52) U.S. Cl.

CPC ..... *E05C 3/004* (2013.01); *E05B 83/24* (2013.01); *E05C 3/12* (2013.01); *E05Y 2201/10* (2013.01); *E05Y 2201/484* (2013.01); *E05Y 2800/296* (2013.01); *E05Y 2900/536* (2013.01); *Y10S 292/14* (2013.01)

(58) Field of Classification Search

CPC ..... E05Y 2900/536; E05C 3/004; E05C 3/12; Y10S 292/14; E05B 83/16; E05B 83/24

See application file for complete search history.

(56) References Cited

U.S. PATENT DOCUMENTS

| | | | | |
|---|---|---|---|---|
| 3,565,476 A | | 2/1971 | Berman | |
| 3,572,793 A | * | 3/1971 | Cole | E05B 83/16 292/216 |
| 3,905,624 A | | 9/1975 | Fujita | |
| 4,961,601 A | | 10/1990 | Lindholm et al. | |
| 4,991,884 A | | 2/1991 | Cairns | |
| 5,000,493 A | | 3/1991 | Bastien | |
| 5,348,355 A | * | 9/1994 | Oyha | E05B 83/16 292/216 |

(Continued)

FOREIGN PATENT DOCUMENTS

| | | | |
|---|---|---|---|
| CN | 103590675 A | * | 2/2014 |
| DE | 102007003292 A1 | | 7/2008 |

(Continued)

*Primary Examiner* — Carlos Lugo
(74) *Attorney, Agent, or Firm* — Michael Best & Friedrich LLP

(57) ABSTRACT

A latch assembly includes a forkbolt biased to rotate in a first direction about a first pivot point, and a detent biased to rotate in a second direction about a second pivot point, the detent configured to engage with the forkbolt in at least two different positions. The latch assembly further includes a tertiary catch biased to rotate in the first direction. The detent is configured to engage a portion of the tertiary catch and rotate the tertiary catch when the detent is rotated in the first direction.

24 Claims, 15 Drawing Sheets

(56) References Cited

U.S. PATENT DOCUMENTS

| | | | | |
|---|---|---|---|---|
| 5,738,393 | A | 4/1998 | Chao | |
| 5,853,060 | A * | 12/1998 | Chao | E05B 83/16 292/216 |
| 6,050,117 | A | 4/2000 | Weyerstall | |
| 6,070,921 | A * | 6/2000 | Valasin | E05B 17/0037 292/216 |
| 6,361,091 | B1 * | 3/2002 | Weschler | E05B 83/24 292/225 |
| 6,371,536 | B1 | 4/2002 | Koerwer et al. | |
| 6,435,573 | B1 | 8/2002 | Szablewski | |
| 6,459,223 | B2 | 10/2002 | Mauel et al. | |
| 6,581,987 | B1 * | 6/2003 | Gentile | E05B 83/24 292/216 |
| 6,588,828 | B2 | 7/2003 | Fisher | |
| 6,648,379 | B1 | 11/2003 | Kordowski et al. | |
| 6,666,483 | B2 | 12/2003 | Baniak et al. | |
| 6,742,819 | B2 | 6/2004 | So et al. | |
| 6,860,356 | B2 | 3/2005 | Peter | |
| 7,163,256 | B2 | 1/2007 | Haunstetter | |
| 7,195,090 | B2 | 3/2007 | Parks et al. | |
| 7,331,616 | B2 | 2/2008 | Brei et al. | |
| 8,284,022 | B2 | 10/2012 | Kachouh | |
| 8,419,114 | B2 | 4/2013 | Fannon et al. | |
| 8,505,987 | B2 | 8/2013 | Browne et al. | |
| 8,534,720 | B2 | 9/2013 | Meyer et al. | |
| 8,573,658 | B2 | 11/2013 | Kim | |
| 8,579,068 | B2 | 11/2013 | Farooq et al. | |
| 8,764,075 | B2 | 7/2014 | Taurasi et al. | |
| 8,935,053 | B2 | 1/2015 | Wheeler et al. | |
| 9,091,102 | B2 | 7/2015 | Krishnan | |
| 9,120,461 | B2 | 9/2015 | Farooq et al. | |
| 9,145,716 | B2 | 9/2015 | Jayasuriya et al. | |
| 9,163,435 | B2 | 10/2015 | Zysk et al. | |
| 9,187,936 | B2 | 11/2015 | Kim et al. | |
| 9,194,163 | B2 | 11/2015 | Margheritti et al. | |
| 9,255,429 | B2 | 2/2016 | Kim et al. | |
| 9,382,731 | B2 | 7/2016 | Kim et al. | |
| 9,777,516 | B2 | 10/2017 | Farooq et al. | |
| 10,577,842 | B2 | 3/2020 | Farris et al. | |
| 10,584,520 | B2 | 3/2020 | Scholz et al. | |
| 10,590,683 | B2 | 3/2020 | Cumbo | |
| 2006/0170224 | A1 * | 8/2006 | Mitchell | E05B 77/04 292/216 |
| 2010/0237632 | A1 | 9/2010 | Browne et al. | |
| 2012/0161456 | A1 | 6/2012 | Riedmayr et al. | |
| 2012/0313384 | A1 | 12/2012 | Cumbo et al. | |
| 2013/0049403 | A1 | 2/2013 | Fannon et al. | |
| 2014/0246870 | A1 | 9/2014 | Kim et al. | |
| 2014/0319848 | A1 | 10/2014 | Fannon | |
| 2014/0361554 | A1 | 12/2014 | Ferri et al. | |
| 2015/0054293 | A1 | 2/2015 | Kim et al. | |
| 2015/0076840 | A1 | 3/2015 | Schoch et al. | |
| 2015/0345185 | A1 | 12/2015 | Farooq et al. | |
| 2015/0345186 | A1 | 12/2015 | Park | |
| 2016/0032626 | A1 | 2/2016 | Margheritti et al. | |
| 2016/0076279 | A1 | 3/2016 | Ilea et al. | |
| 2017/0096845 | A1 | 4/2017 | Bendel | |
| 2017/0138098 | A1 | 5/2017 | Covarrubias Pazaran | |
| 2017/0191291 | A1 | 7/2017 | Scholz et al. | |
| 2017/0241169 | A1 | 8/2017 | Rao et al. | |
| 2018/0073283 | A1 | 3/2018 | Kim et al. | |
| 2019/0145135 | A1 | 5/2019 | Lebsak et al. | |
| 2020/0071971 | A1 * | 3/2020 | Cho | B62D 25/12 |

FOREIGN PATENT DOCUMENTS

| | | | |
|---|---|---|---|
| DE | 102007003293 | A1 | 7/2008 |
| DE | 102007005444 | A1 | 8/2008 |
| DE | 102007007633 | A1 | 8/2008 |
| DE | 102007008700 | A1 | 8/2008 |
| DE | 102009034904 | A1 | 2/2011 |
| DE | 102010062700 | A1 | 6/2012 |
| DE | 102019110702 | A1 * | 10/2020 |
| KR | 20170043831 | A * | 4/2017 |

* cited by examiner

LATCH ASSEMBLY

CROSS-REFERENCE TO RELATED APPLICATIONS

This application claims priority to U.S. Provisional Application No. 62/793,682, filed Jan. 17, 2019, the entire contents of which are incorporated herein by reference.

FIELD OF THE INVENTION

The present invention relates to latch assemblies, and more specifically latch assemblies for motor vehicles.

BACKGROUND OF THE INVENTION

Many current motor vehicles include compartments (e.g., hoods, trunks, etc.) that are latched with latch assemblies. The latch assemblies enable an operator to push down on the compartment, and to have the compartment latched and locked in place until the operator desires to unlatch the compartment.

Frunks (front trunk compartments) are now commonly found in certain electric vehicles and mid/rear-engine vehicles, and are used in place of the common rear trunk to store materials such as luggage or other items. Frunks, however, must meet certain Federal Motor Vehicle Safety Standards (FMVSS) relating to front opening hoods. For example, frunks must have a two-step release for any latch that is used to secure the frunk. Additionally, frunks must meet FMVSS entrapment regulations similar to a traditional rear trunk when the vehicle is not moving, and open partially when the vehicle is above a certain speed.

SUMMARY OF THE INVENTION

In accordance with one embodiment, a latch assembly includes a forkbolt biased to rotate in a first direction about a first pivot point, and a detent biased to rotate in a second direction about a second pivot point, the detent configured to engage with the forkbolt in at least two different positions. The latch assembly further includes a tertiary catch biased to rotate in the first direction. The detent is configured to engage a portion of the tertiary catch and rotate the tertiary catch when the detent is rotated in the first direction.

In accordance with another embodiment, a latch assembly includes a housing defining a fishmouth, and a forkbolt disposed at least partially within the housing and biased to rotate in a first direction about a first pivot point. The latch assembly further includes a detent disposed at least partially within the housing and biased to rotate in a second direction about a second pivot point, the detent configured to engage with the forkbolt in at least two different positions. The latch assembly further includes a tertiary catch disposed at least partially within the housing and biased to rotate about a third pivot point. In a first position of the tertiary catch a region of the tertiary catch is positioned adjacent the fishmouth, and in a second position of the tertiary catch the region of the tertiary catch is positioned away from the fishmouth In accordance with another embodiment, a latch assembly includes a detent, a forkbolt, and a tertiary catch, wherein the forkbolt restrains a striker. A method of operating the latch assembly includes rotating the detent a first time to cause a first rotational movement of the forkbolt, and rotating the detent a second time to cause a second rotational movement of the forkbolt, wherein the second rotational movement releases the striker from the forkbolt. The method further includes rotating the tertiary catch to a position to re-secure the striker and restrain the striker from further movement away from the latch assembly.

Other features and aspects of the invention will become apparent by consideration of the following detailed description and accompanying drawings.

Before any embodiments of the invention are explained in detail, it is to be understood that the invention is not limited in its application to the details of construction and the arrangement of components set forth in the following description or illustrated in the following drawings. The invention is capable of other embodiments and of being practiced or of being carried out in various ways. Also, it is to be understood that the phraseology and terminology used herein is for the purpose of description and should not be regarded as limiting.

DETAILED DESCRIPTION

FIGS. 1-11 illustrate a latch assembly 10. While the latch assembly 10 is primarily intended for use with a frunk on a commercial motor vehicle such as vehicle 12 illustrated in FIG. 1A (e.g., sedan, SUV, minivan, truck, etc.), the latch assembly 10 may also be used with other types of machines or vehicles, or on other locations of a machine or vehicle where a latch assembly 10 may be beneficial to control operation of a compartment.

Figure 1A:
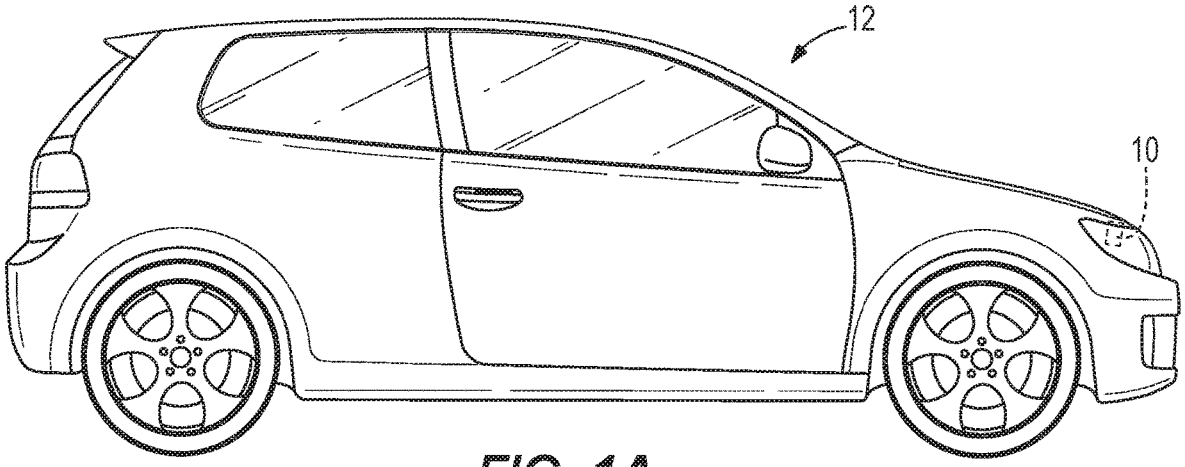
FIG. 1A is a schematic, side view of a vehicle, illustrating a location for a latch assembly according to one embodiment.
Figure 1B:
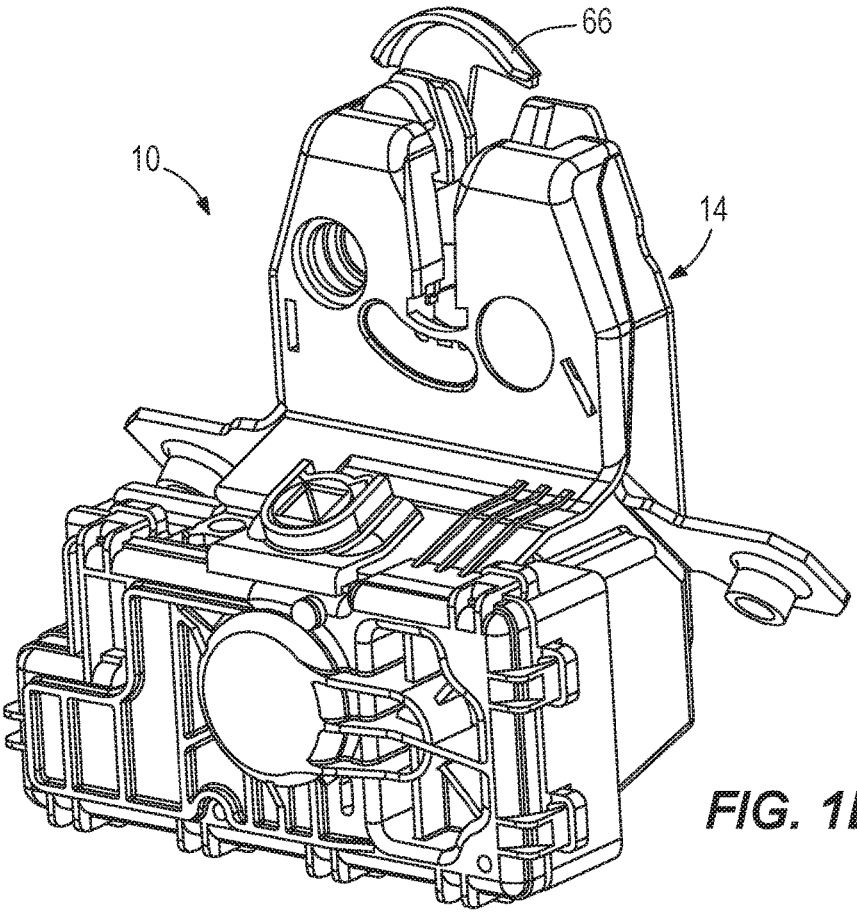
FIG. 1B is a perspective view of the latch assembly.
Figure 2:
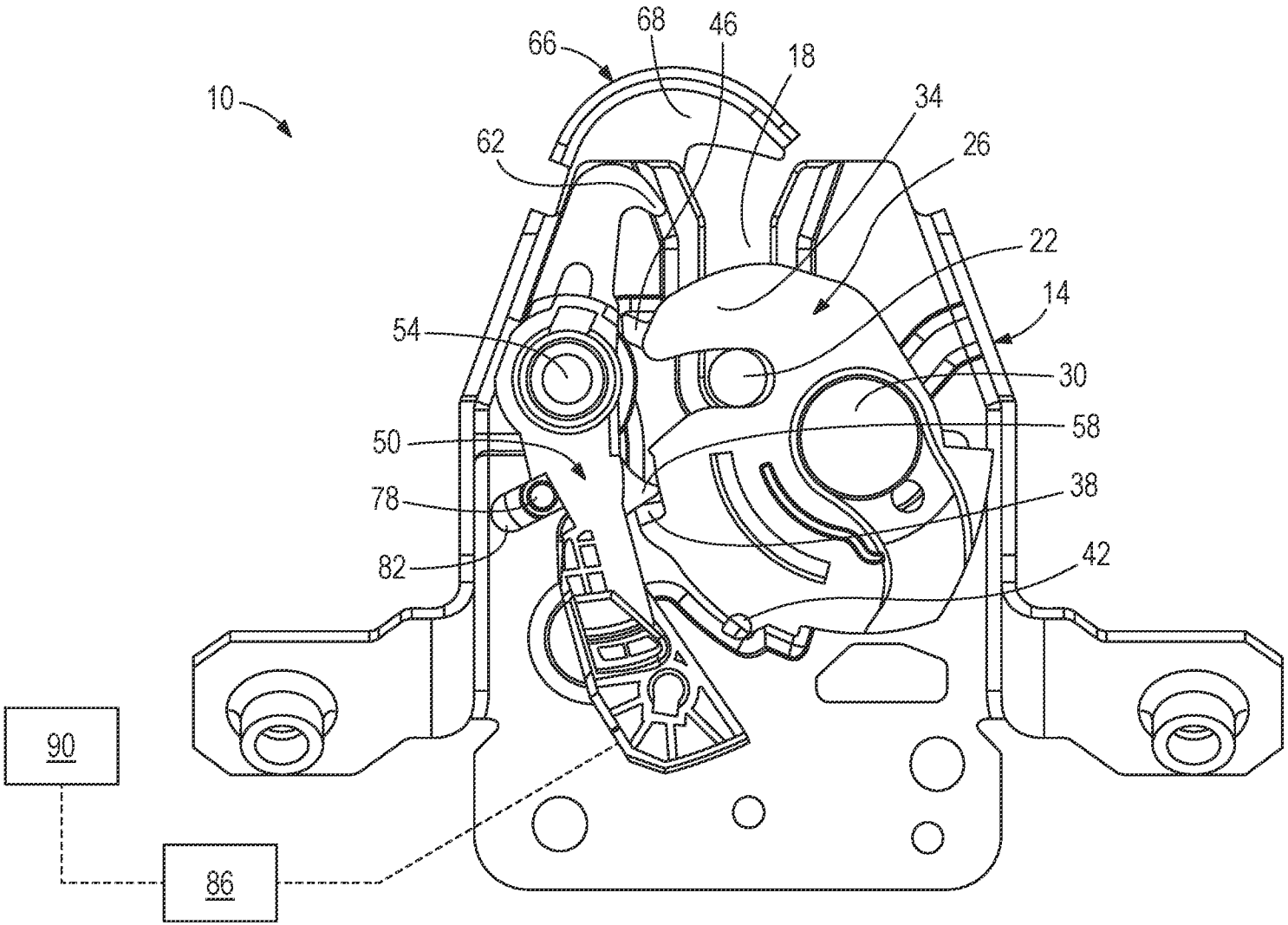
FIG. 2 is a front view of a portion of the latch assembly of FIG. 1, illustrating a forkbolt, detent, and tertiary catch.
Figure 3:
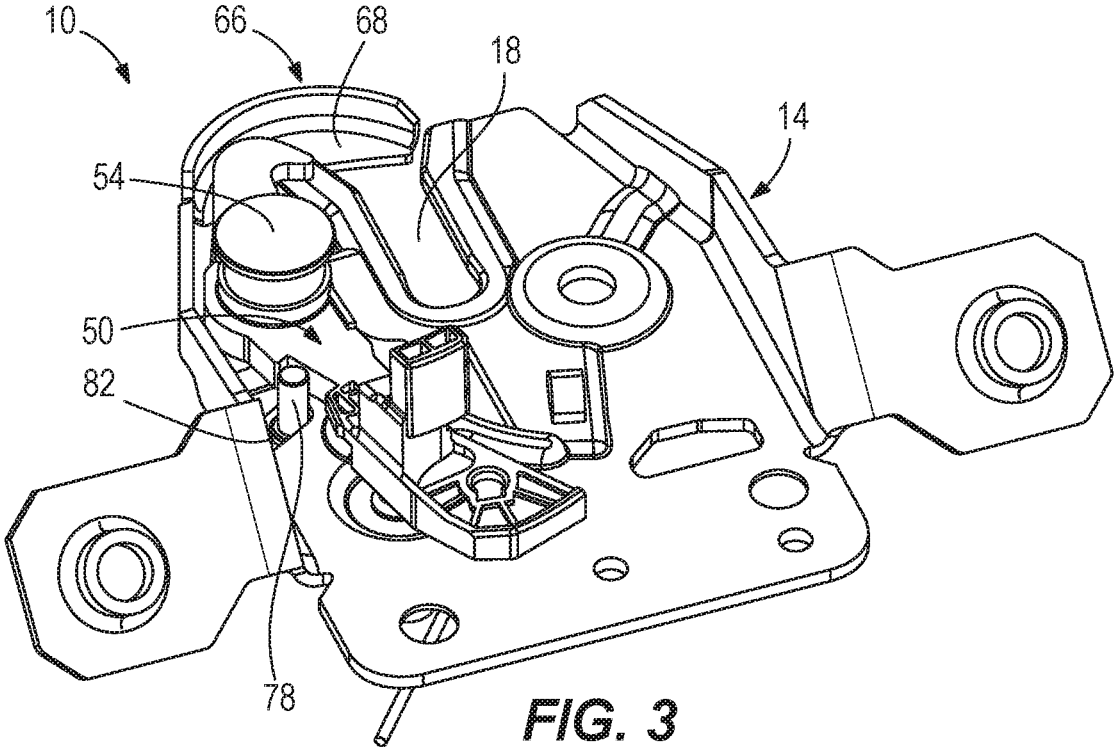
FIGS. 3 and 4 are front and rear perspective views, respectively, of a portion of the latch assembly of FIG. 1, illustrating how the detent and tertiary catch engage with one another.

With reference to FIGS. 1-11, the latch assembly 10 includes a housing 14. As illustrated in FIG. 3, the housing 14 defines an elongate fishmouth (i.e., slot) 18 that is sized and shaped to receive a striker 22 (FIG. 2). The housing 14 may have shapes and sizes other than that illustrated. In some embodiments, the housing 14 is coupled (e.g., fixed)

directly to an interior of a motor vehicle, adjacent a compartment of the motor vehicle.

The latch assembly 10 further includes a forkbolt (i.e., catch) 26 disposed at least partially within the housing 14. With reference to FIG. 2, the forkbolt 26 rotates about a forkbolt pivot point 30 (e.g., pin) in the housing 14. In the illustrated embodiment, the forkbolt 26 is biased (e.g., with a torsion spring or other biasing element) to rotate clockwise about the forkbolt pivot point 30 as viewed in FIG. 2, although other embodiments include different rotational directions or movement of the forkbolt 26, as well as different biasing elements to bias the forkbolt 26. With continued reference to FIG. 2, in the illustrated embodiment the forkbolt 26 includes a forkbolt main arm 34, a first forkbolt latching projection 38, a second forkbolt latching projection 42, and a forkbolt stop projection 46. As illustrated in FIG. 2, the forkbolt stop projection 46 extends from an end of the main arm 34.

With reference to FIGS. 1-11, the latch assembly 10 further includes a detent (i.e., pawl) 50 disposed at least partially within the housing 14. As illustrated in FIG. 2, the detent 50 rotates about a detent pivot point 54 (e.g., pin) in the housing 14, and includes a detent latching projection 58 and a detent stop projection 62 (e.g., hook). In the illustrated embodiment, the detent 50 is biased (e.g., with a torsion spring or other biasing element) to rotate counter-clockwise about the detent pivot point 54, although other embodiments include different rotational directions or movement of the detent 50, as well as different biasing elements to bias the detent 50.

Figure 4:
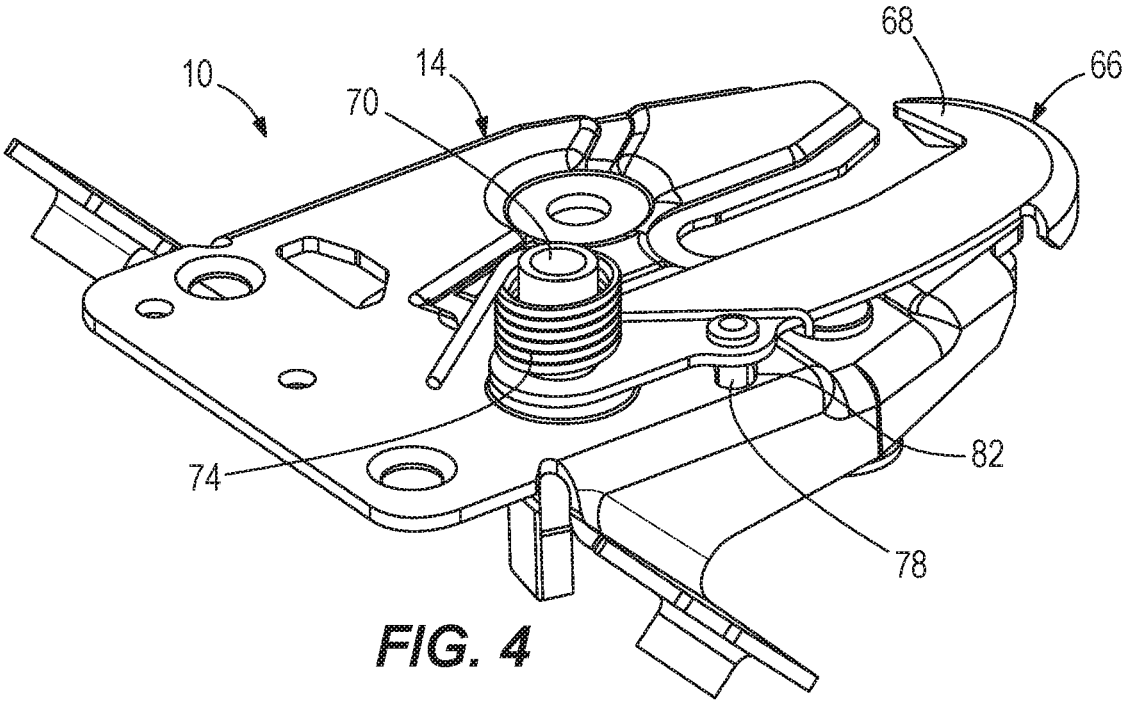
Figure 5B:
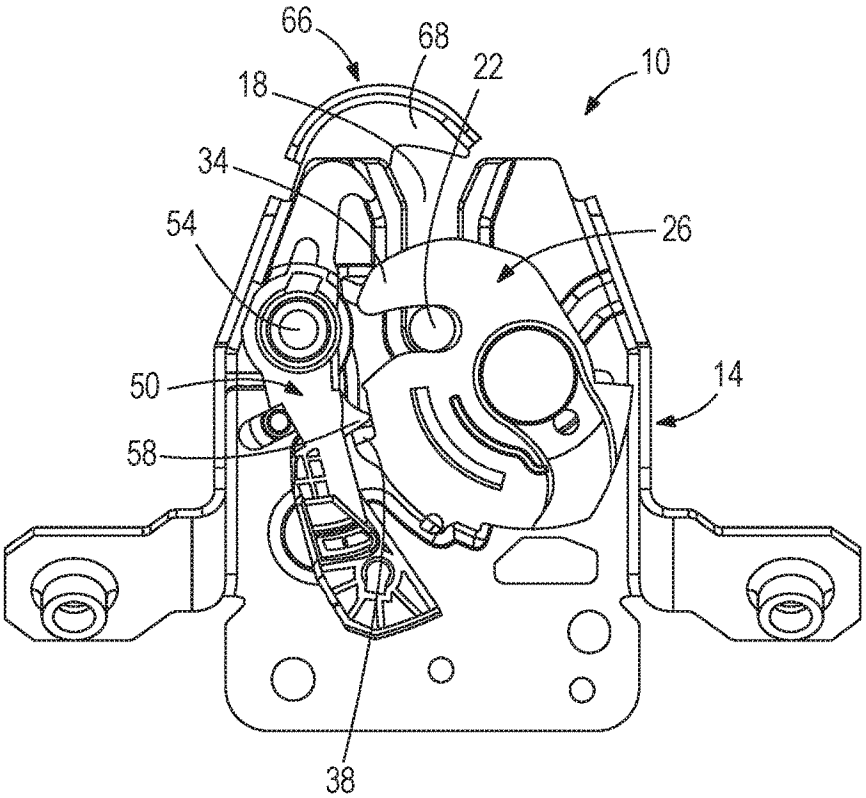
FIGS. 5A and 5B illustrate a primary position of the latch assembly of FIG. 1.
Figure 5A:
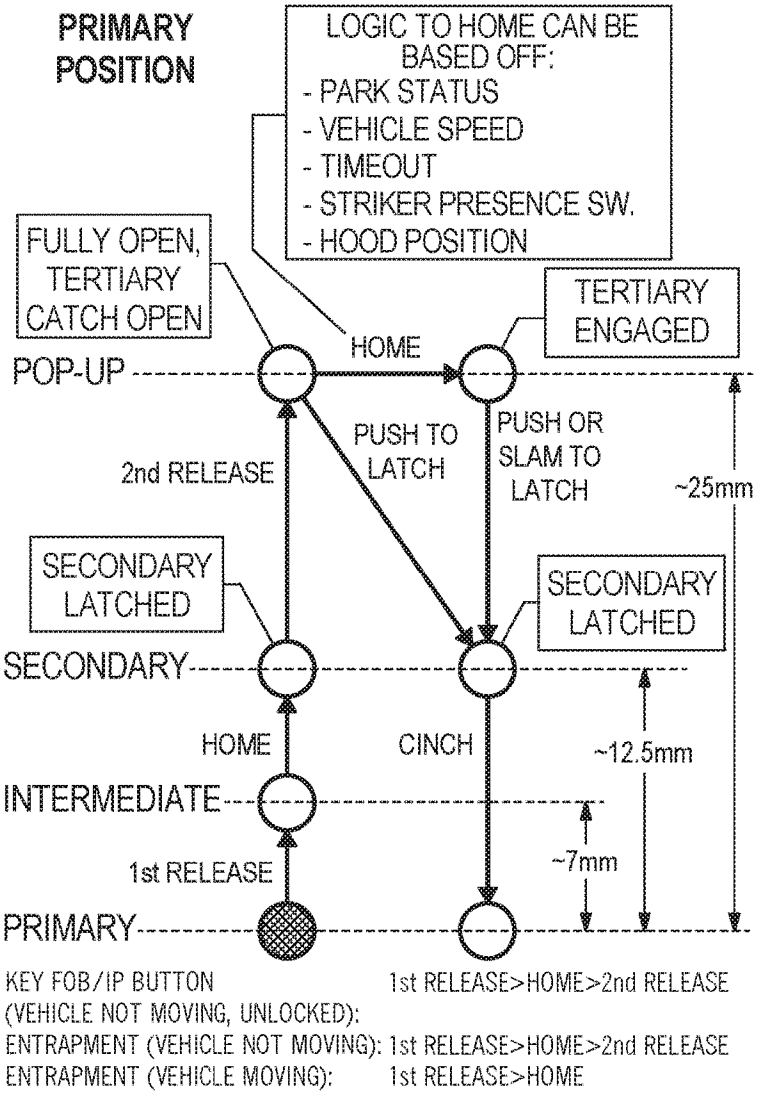

With reference to FIGS. 1-11, the latch assembly 10 further includes a tertiary catch 66 disposed at least partially within the housing 14. In the illustrated embodiment the tertiary catch 66 is an elongate lever arm that includes a hook region 68 at a top of the lever arm. The hook region 68 is sized and shaped to extend over the fishmouth 18 in at least one position of the tertiary catch 66. As illustrated in FIG. 4, the tertiary catch 66 rotates about a pivot point 70 (e.g., pin). The tertiary catch 66 is biased by a biasing member 74. In the illustrated embodiment the biasing member 74 is a coiled torsion spring wrapped about the pivot point 70, although other embodiments include different biasing members (e.g., leaf spring, etc.) With reference to FIGS. 2-4, the tertiary catch 66 additionally includes a pin 78 (i.e., projecting body) that extends through a slot 82 of the housing 14. As described further herein, during use the pin 78 is contacted and pressed by the detent 50 and moved within the slot 82 when the detent 50 is rotated, so as to tension the biasing member 74. As illustrated in FIGS. 3 and 4, the pin 78 is disposed below the pivot point 54 of the detent 50, and above the pivot point 70 of the tertiary catch 66. Thus, the biasing member 74 (in conjunction with the pin 78) acts to bias the tertiary catch 66 in a clockwise direction as viewed in FIGS. 2 and 3, and also acts to bias the detent 50 in a counter-clockwise direction as viewed in FIGS. 2 and 3. Other embodiments include different shapes and sizes of pins 78 than that illustrated. In some embodiments the pin 78 is integrally formed as a single piece with a remainder of the tertiary catch 66. Additionally, while the slot 82 is a through-opening that extends through the housing 14 in the illustrated embodiment, in other embodiments the slot 82 may be a groove or recessed region of the housing 14 that does not extend entirely through the housing 14. In some embodiments, no slot 82 is provided at all. In some embodiments the detent 50 and the tertiary catch 66 each have their own separate biasing member that biases the detent 50 and tertiary catch 66, respectively. Additionally, in some embodiments the pin 78 may be located on the detent rather than on the tertiary catch 66. Additionally, in some embodiments one or more of the forkbolt 26, detent 50, and tertiary catch 66 is biased in a direction other than that illustrated.

With reference to FIG. 2, the latch assembly 10 further includes an actuator 86 coupled to the detent 50. The actuator 50 acts to rotate the detent 50 about the pivot point 54 (e.g., clockwise in FIG. 2 against the biasing force of the biasing member 74 or other biasing member that biases the detent 50). The actuator 86 may be a physical structure, such as a cable or rod, that is disposed within the vehicle (e.g., adjacent the driver seat) and that may be pulled (e.g., with a handle) by the driver. In some embodiments the actuator 86 is instead a motor (e.g., electric motor) that when activated rotates the detent 50. At least a portion of the actuator 86 may be disposed remotely from the detent 50, or may be disposed on the detent 50 itself or directly adjacent the detent 50. As illustrated in FIG. 2, in some embodiments the actuator 86 is controlled via a controller 90. The controller 90 may be located on the vehicle, or may be a keyfob or other handheld device that is used by the driver to control activation of the actuator 86 and to control movement of the detent 50. In some embodiments, the controller 90 may be a button or other device disposed within the frunk itself in the event someone is entrapped in the frunk and needs to release the striker 22 to allow the hood to open.

With reference to FIGS. 5-11, the latch assembly 10 may be operated and moved into various positions during use. For example, with reference to FIGS. 5A and 5B, in a primary position the forkbolt 26 is rotated fully in a counterclockwise direction and the detent 50 is rotated fully in a counterclockwise direction. The striker 22 is held by the main arm 34 within the fishmouth 18, and the detent latching projection 58 is disposed above and engaged with the first forkbolt latching projection 38. The tertiary catch 66 is positioned such that the hook region 68 extends over the fishmouth 18.

Figure 6B:
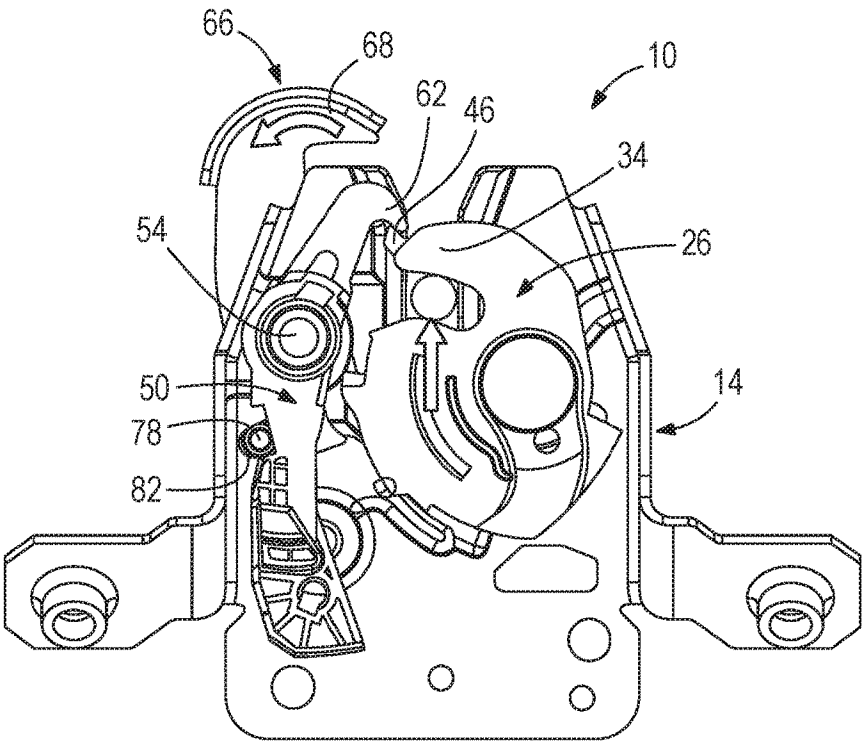
FIGS. 6A and 6B illustrate an intermediate position of the latch assembly of FIG. 1.
Figure 6A:
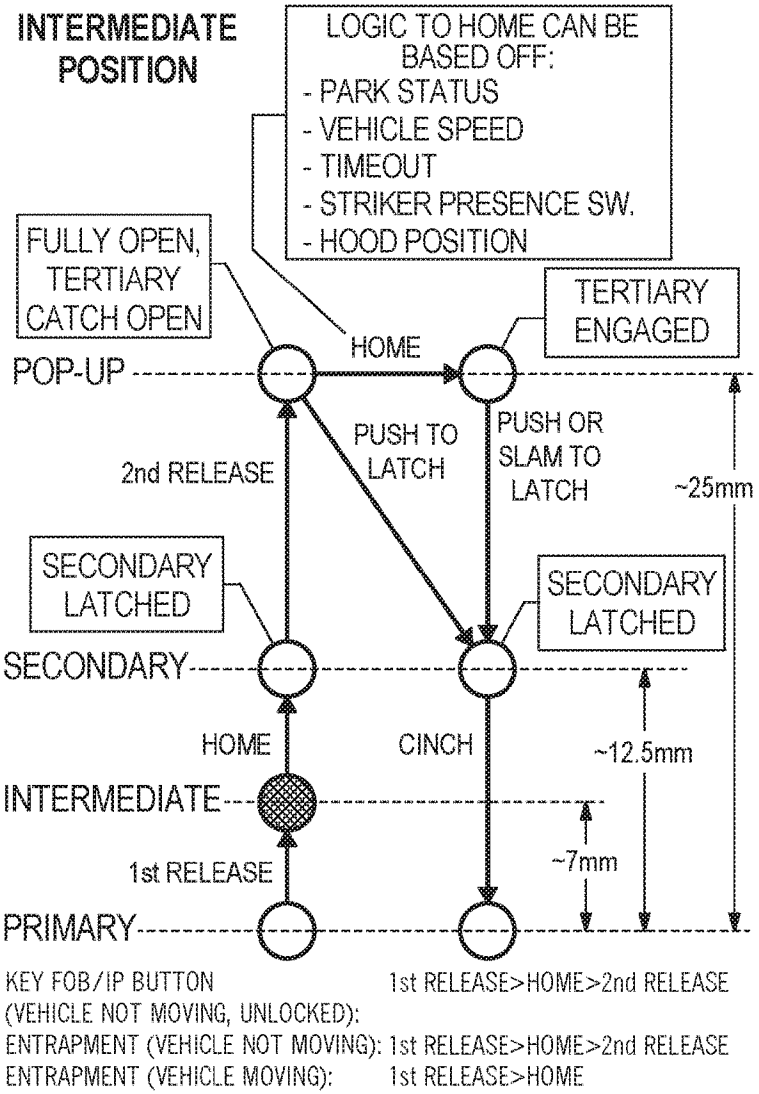

With reference to FIGS. 2, 6A, and 6B, the actuator 86 may be activated (e.g., via the controller 90) to pull on the detent 50 and rotate the detent 50 clockwise about the pivot point 54. This movement causes a release between the detent latching projection 58 and the first forkbolt latching projection 38, allowing the forkbolt 26 to rotate clockwise until the detent stop projection 62 engages the forkbolt stop projection 46, thereby stopping the rotation of the forkbolt 26. Additionally, this movement of the detent 50 causes the detent 50 to engage and press against the pin 78, thereby sliding the pin 78 within the slot 82 and rotating the tertiary catch 66 counterclockwise into a position where the hook region 68 is swung away from the fishmouth 18.

Figure 7B:
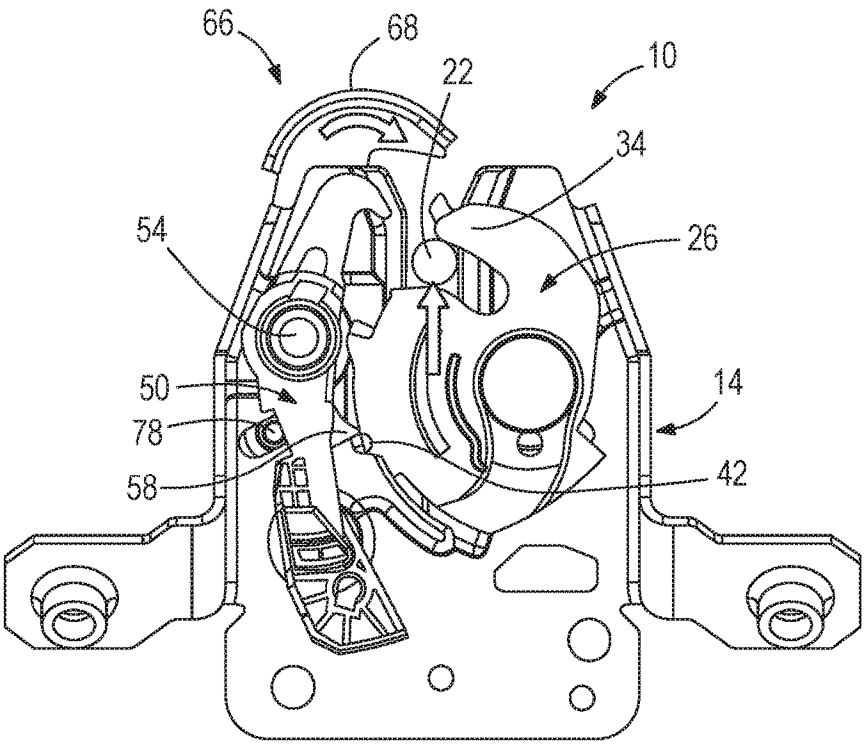
FIGS. 7A and 7B illustrate a secondary position of the latch assembly of FIG. 1.
Figure 7A:
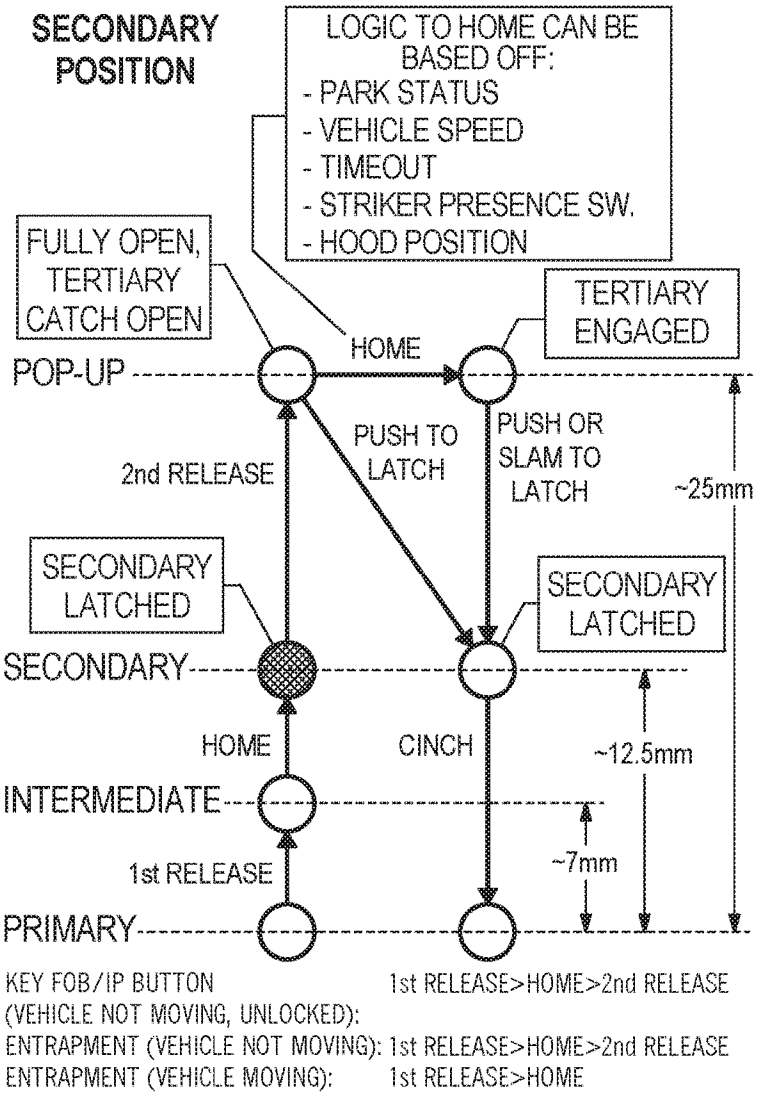

With reference to FIGS. 7A and 7B, once the actuator 86 is released or deactivated, the detent 50 then rotates back in a counterclockwise direction as viewed in FIG. 7B (via the bias of the biasing member 74). This movement of the detent 50 causes the detent latching projection 58 to engage the second forkbolt latching projection 42, again stopping rotation of the forkbolt 26. In this position, and as illustrated in FIG. 7B, the striker 22 is still retained by the main arm 34.

Figure 8B:
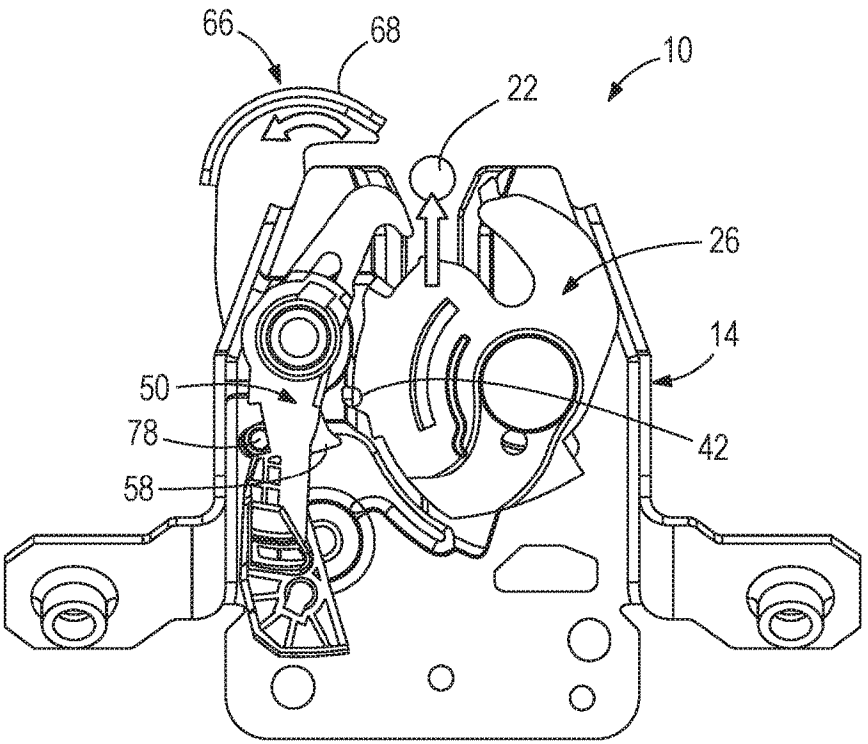
FIGS. 8A and 8B illustrate a pop-up position of the latch assembly of FIG. 1.
Figure 8A:
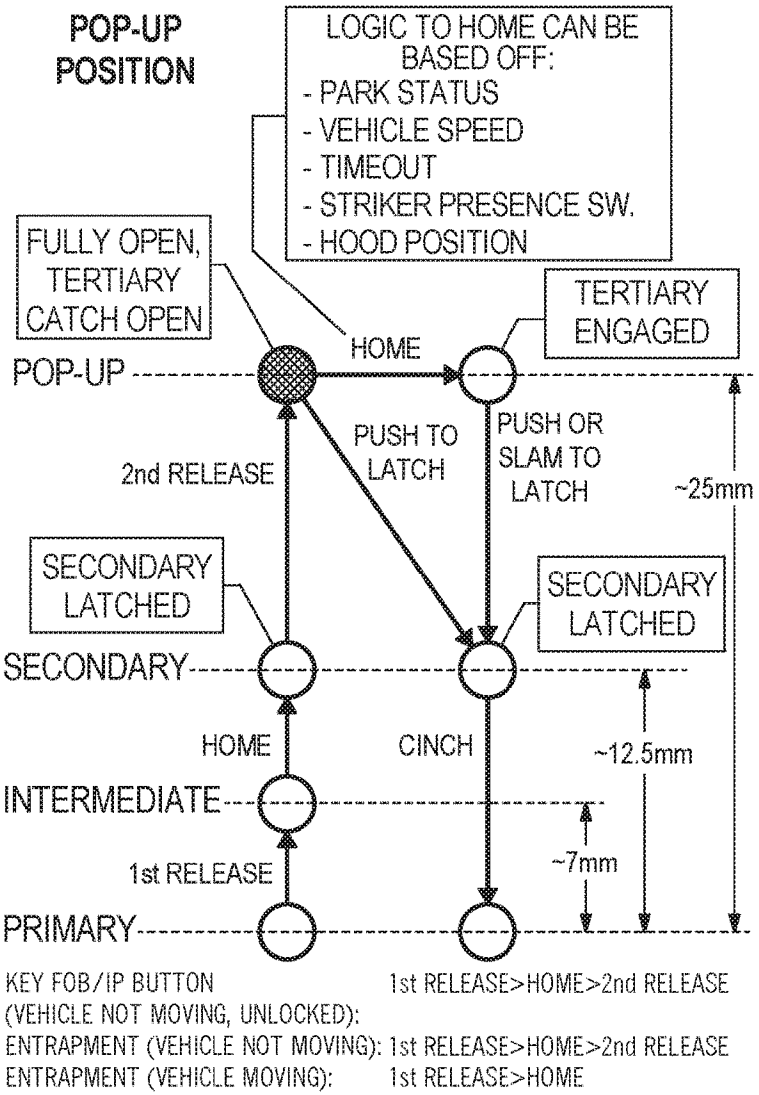

With reference to FIGS. 8A and 8B, the actuator 86 may then be activated a second time. When the actuator 86 is activated, the detent 50 is again pulled and rotated in a clockwise direction, causing a release between the detent latching projection 58 and the second forkbolt latching projection 42. This release allows the forkbolt 26 to again rotate clockwise as viewed in FIG. 8B, until the striker 22 is no longer retained by the main arm 34 of the forkbolt 26. In some embodiments a pop-up mechanism (e.g., lever, spring, etc.) is provided that further aids in "popping up" the striker 22. As illustrated in FIG. 8B, in this position the hook portion 68 of the tertiary catch 66 is swung away from the fishmouth 18. The striker 22 is approximately 25 mm higher than it was in the initial primary position of FIG. 5B (i.e., the front of the hood is raised approximately 25 mm), although other embodiments include different values or ranges of values. Thus, if desired an operator could walk to the front of the vehicle at this stage and reach in with one hand to lift up on the hood to raise the hood, or someone entrapped within the frunk could push the hood open from inside the frunk.

Figure 9B:
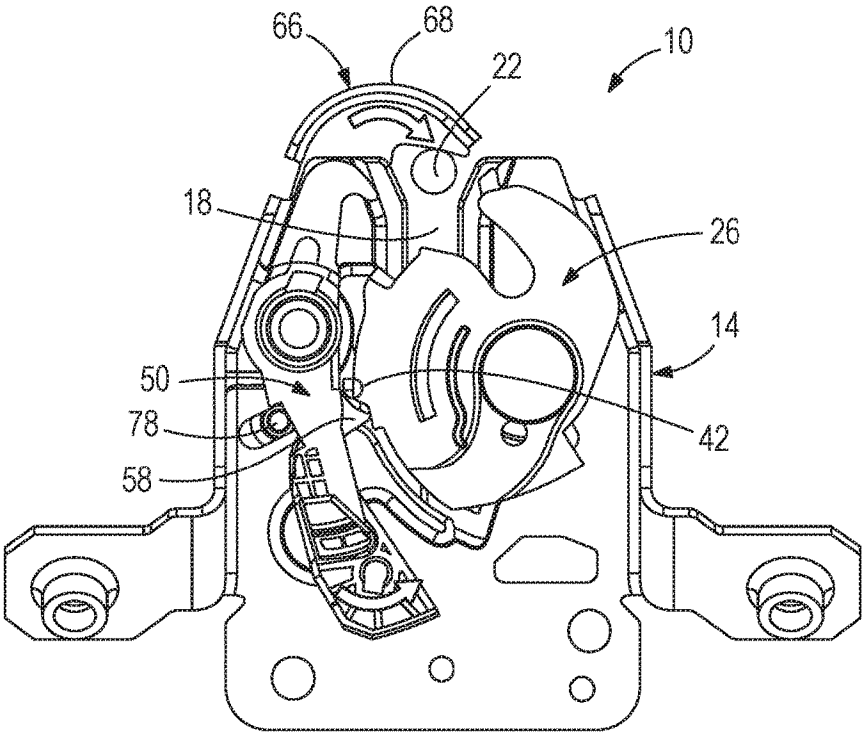
FIGS. 9A and 9B illustrate a tertiary engaged position of the latch assembly of FIG. 1.
Figure 9A:
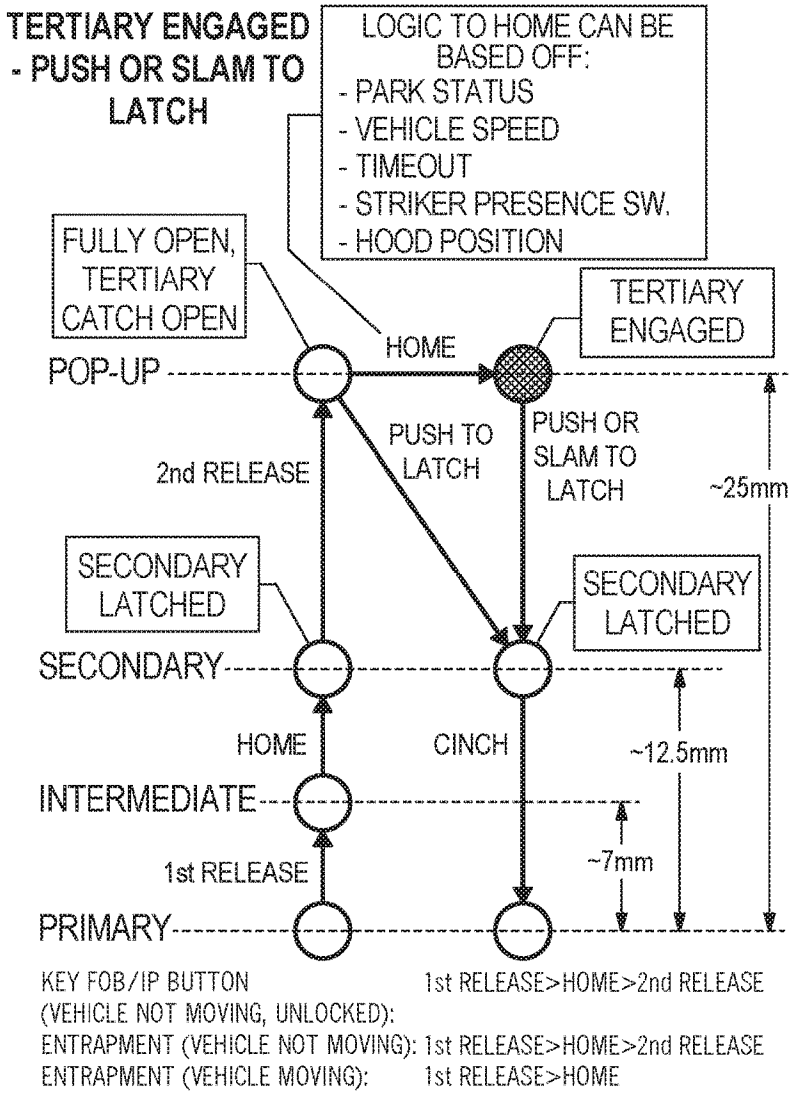

With reference to FIGS. 9A and 9B, during one or more conditions the detent 50 may then be rotated back in a counterclockwise direction. This rotation forces the pin 78 to slide back along the slot 82, and the biasing member 74 to bias the tertiary catch 74 in a clockwise direction until the hook portion 68 swings back and is positioned over the fishmouth 18, thereby blocking vertical movement of the striker 22. Again, in this position the striker 22 is still approximately 25 mm higher than it was in the initial primary position of FIG. 5B, although other embodiments include different values or ranges of values. As illustrated in FIG. 9B, in this position the detent latching projection 58 is also positioned underneath the second forkbolt latching projection 42.

In some embodiments, the movement of the tertiary catch 66 between the positions illustrated in FIGS. 8B and 9B may be controlled based on a parking status of the vehicle, a vehicle speed, a timeout, a striker position, and/or a hood position. For example, the vehicle may include one or more sensors in communication with or formed as part of the controller 90 to detect a condition of the vehicle. In some embodiments, if it is detected that the vehicle is not moving (e.g., it is parked), the detent 50 may be held (e.g., via the actuator 86) in the position illustrated in FIG. 8B, thereby allowing the hood to be full raised. The detent 50 may be held for a predetermined period of time, or may be held for example until the vehicle sends a signal via the controller 90 to release the actuator 86, thereby allowing the detent 50 and the tertiary catch 66 to rotate to the positions illustrated in FIG. 9B. In contrast, if it is detected the vehicle is moving, or that the vehicle is moving at a predetermined speed, it may not be desirable for the hood to fly open, blocking the view of the driver. Therefore, the detent 50 may be released immediately (or after a predetermined period of time has passed since the latch assembly 10 has reached the position illustrated in FIG. 8A), allowing the detent 50 to rotate counterclockwise and consequently the tertiary catch 66 to rotate clockwise until the hook portion 68 is securely over the fishmouth 18 and blocking the striker 22. Thus, the position illustrated in FIG. 9B may be used to inhibit or prevent the hood from unintentionally flying open. In yet other embodiments the vehicle may include a striker presence sensor that determines a position of the striker 22, and/or a hood position sensor that determines a position of the hood. Information from these sensors may also be used to determine whether the tertiary catch 66 should be moved from the position illustrated in FIG. 8B to the position in FIG. 9B.

Figure 10B:
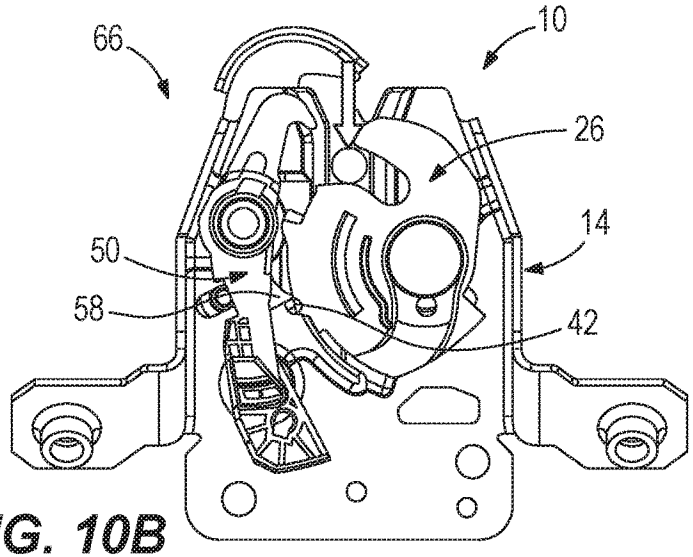
FIGS. 10A-10C illustrate a re-latching process of the latch assembly of FIG. 1.
Figure 10C:
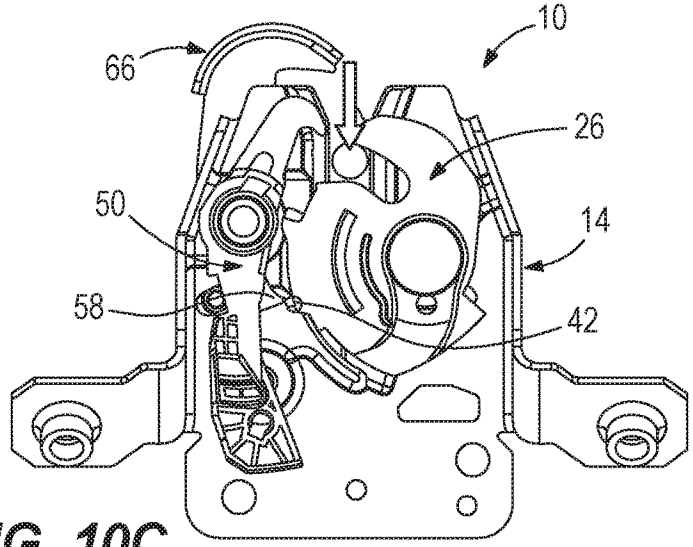
Figure 10A:
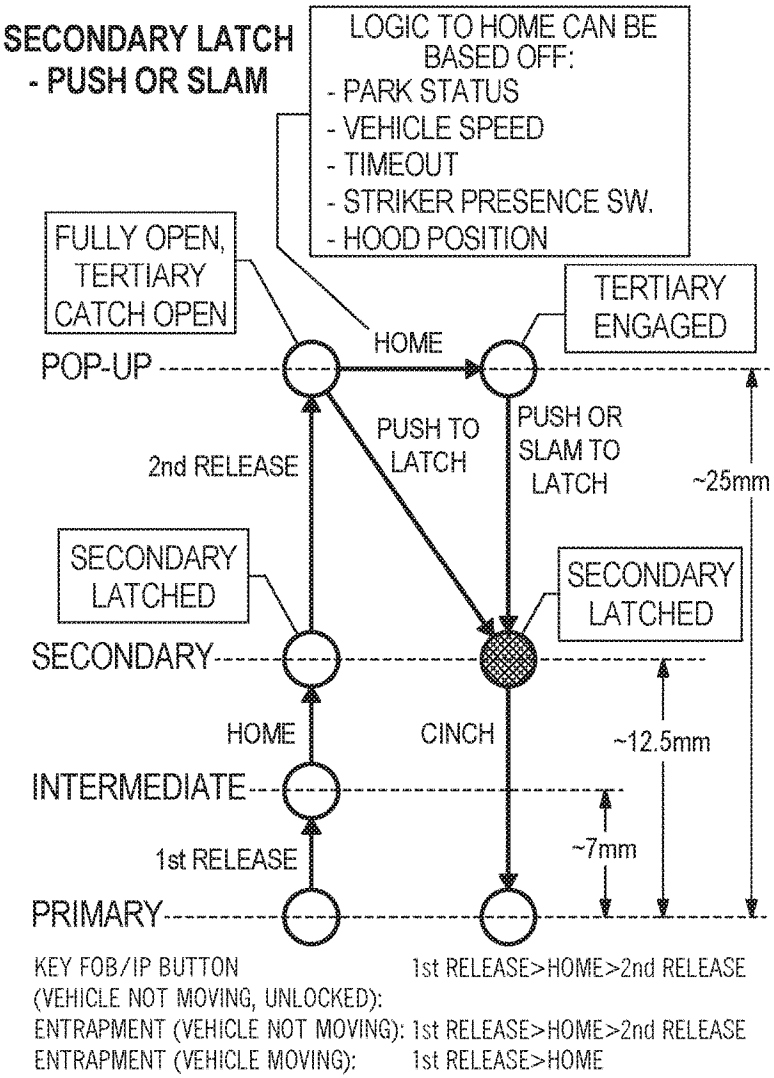

With reference to FIGS. 10A-10C, the latch assembly 10 may be latched from either the position in FIG. 8B (where the tertiary catch 66 is fully open and the hook portion 68 is swung away from the fishmouth 18) or the position in FIG. 9B (where the tertiary catch is fully closed and the hook portion 68 is disposed over the fishmouth 18). In either case, pushing and/or slamming the frunk hood down moves the striker 22 against the forkbolt 26, causing the forkbolt to rotate in a counterclockwise direction as viewed in FIGS. 10B and 10C. This movement forces the detent 50 to move in a clockwise direction, and the tertiary catch 66 to therefore move in a counterclockwise direction. For example, and with reference to FIG. 10B, if the latch assembly 10 is in the position illustrated in FIG. 9B (tertiary engaged), the detent 50 is already engaged with the forkbolt 26, and the frunk hood may be slammed or pushed to latch. Alternatively, and with reference to FIG. 10C, if the latch assembly is in the position illustrated in FIG. 8B, a switch signal will need to be provided to release the detent 50 so that the detent 50 may engage the forkbolt. The frunk hood must be pushed and held until latching occurs.

Figure 11B:
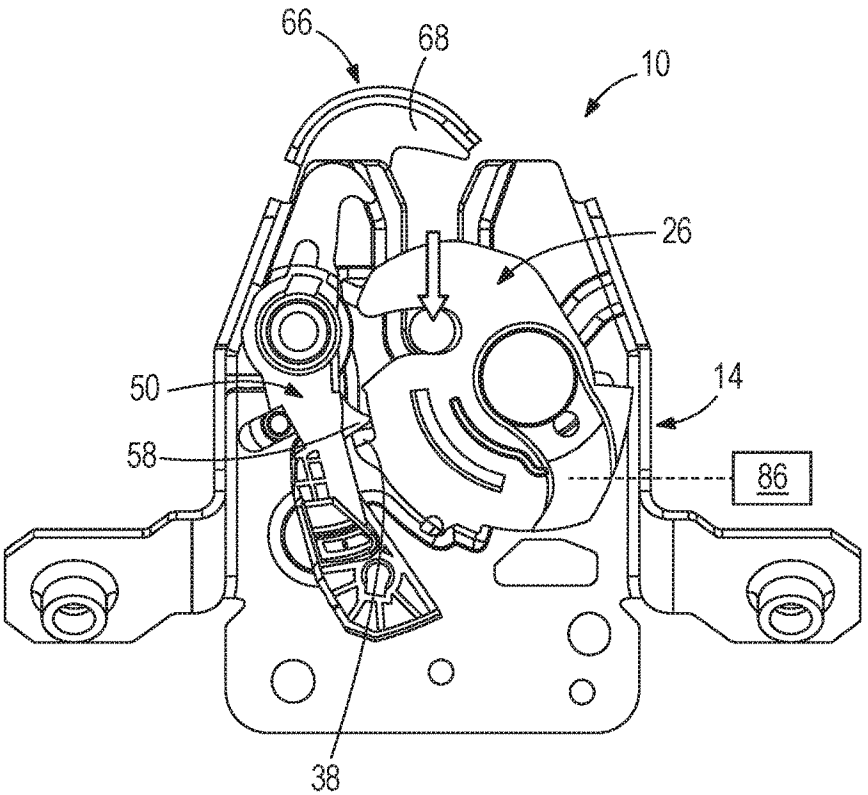
FIGS. 11A and 11B illustrate a cinching process of the latch assembly of FIG. 1
Figure 11A:
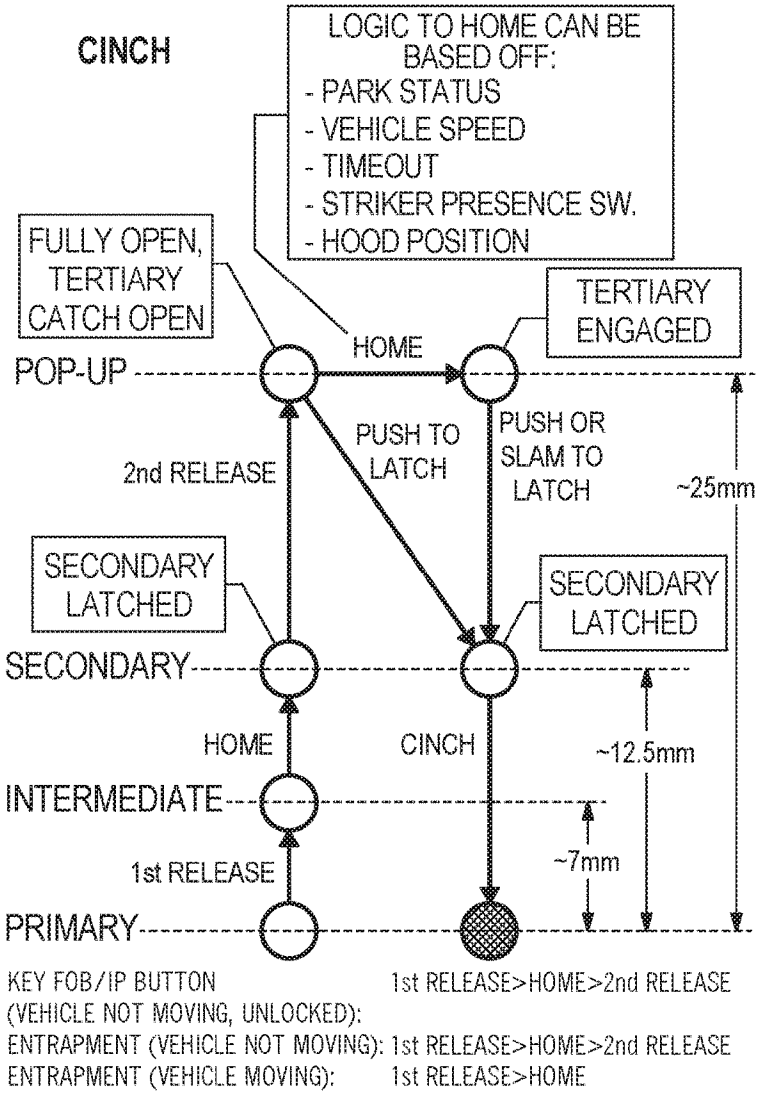

With reference to FIGS. 10A-11B, once the forkbolt 26 has been rotated by the pushing or slamming action and the latch assembly 10 is in a secondary latched position (i.e., where the second forkbolt latching projection 42 is disposed under the detent latching projection 58 as illustrated in FIGS. 10B and 10C), the striker may then be cinched. The cinching operation is an operation in which the forkbolt 26 is further rotated automatically (e.g., via a motor), until the detent latching projection 58 is disposed under and engaged with the first forkbolt latching projection 38 (as illustrated in FIG. 11B), and the latch assembly 10 is again back in the primary position similar to that of FIGS. 5A and 5B. In some embodiments, a cinching actuator (e.g., motor) may be coupled to the forkbolt 26 to rotate the forkbolt 26 and complete the cinching operation. For example, as illustrated in FIG. 11B, the actuator 86 described above may also be used to rotate the forkbolt 26 and complete the cinching operation. In other embodiments a separate cinching actuator may be provided.

FIGS. 12-21 illustrate another latch assembly 110. While the latch assembly 110 is primarily intended for use with a frunk on a commercial motor vehicle (e.g., sedan, SUV, minivan, truck, etc.), the latch assembly 110 may also be used with other types of machines or vehicles, or on other locations of a machine or vehicle where a latch assembly 110 may be beneficial to control operation of a compartment.

Similar to the latch assembly 10, the latch assembly 110 includes a housing 114 that defines an elongate fishmouth (i.e., slot) 118 that is sized and shaped to receive a striker 122. The housing 114 may have shapes and sizes other than that illustrated. In some embodiments, the housing 114 is coupled (e.g., fixed) directly to an interior of a motor vehicle, adjacent a compartment of the motor vehicle.

The latch assembly 110 further includes a forkbolt (i.e., catch) 126 disposed at least partially within the housing 114. The forkbolt 126 rotates about a forkbolt pivot point 130 (e.g., pin) in the housing 114. In the illustrated embodiment, the forkbolt 126 is biased (e.g., with a torsion spring or other biasing element) to rotate clockwise about the forkbolt pivot point 130 as viewed in FIGS. 12-16, although other embodiments include different rotational directions or movement of the forkbolt 126, as well as different biasing elements to bias the forkbolt 126. With continued reference to FIGS. 12-16, in the illustrated embodiment the forkbolt 126 includes a forkbolt main arm 134, and a forkbolt latching projection 138, similar to the forkbolt 26.

With continued reference to FIGS. 12-21, the latch assembly 110 further includes a detent (i.e., pawl) 150 disposed at least partially within the housing 114. The detent 150 rotates about a detent pivot point 154 (e.g., pin) in the housing 114, and includes a detent latching projection 158, similar to the detent 50. In the illustrated embodiment, the detent 150 is biased (e.g., with a torsion spring or other biasing element)

to rotate counter-clockwise about the detent pivot point 154, although other embodiments include different rotational directions or movement of the detent 150, as well as different biasing elements to bias the detent 150.

Figure 18:
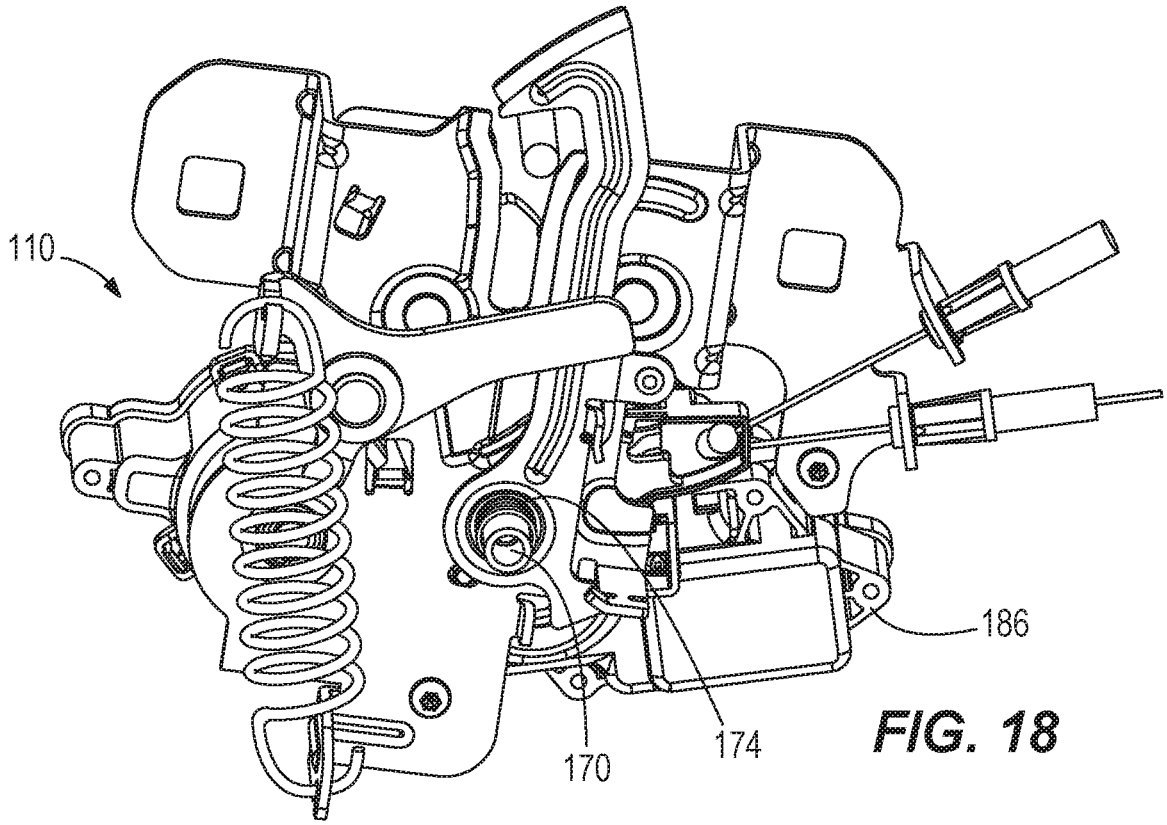

The latch assembly 110 further includes a tertiary catch 166 disposed at least partially within the housing 114. Similar to the tertiary catch 66, the tertiary catch 166 is an elongate lever arm that includes a hook region 168 at a top of the lever arm. The hook region 168 is sized and shaped to extend over the fishmouth 118 in at least one position of the tertiary catch 166. With reference to FIG. 18, the tertiary catch 166 rotates about a pivot point 170 (e.g., pin), and is biased by a biasing member 174. In the illustrated embodiment the biasing member 174 is a coiled torsion spring wrapped about the pivot point 170, although other embodiments include different biasing members (e.g., leaf spring, etc.). In some embodiments, one or more of the forkbolt 126, detent 150, and tertiary catch 166 is biased in a direction other than that illustrated.

Figure 12:
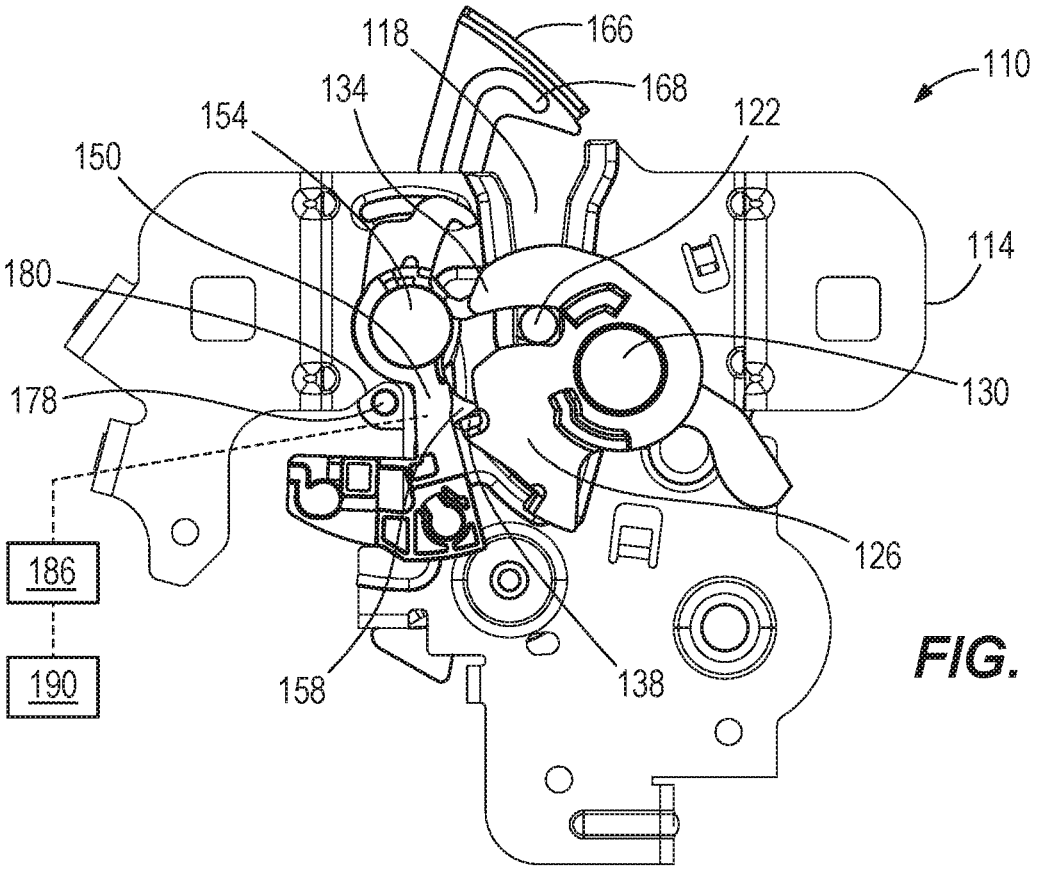
FIGS. 12-16 illustrate a latch assembly according to another embodiment.

With reference to FIGS. 12-16, the tertiary catch 166 additionally includes a pin 178 (i.e., projecting body). In contrast to the pin 78 described above, the pin 178 does not extend through a slot of the housing 114. Rather, and as illustrated in FIG. 12, the pin 178 is positioned within a recessed area, or notch 180, of the housing 114. In other embodiments, the pin 178 may extend through a designated slot in the housing 114, similar to the pin 78 described above.

During use the pin 178 may be contacted and pressed by the detent 150 and moved (e.g., along the notch 180) so as to tension the biasing member 174 and to rotate the tertiary catch 166. Similar to the pin 78, the pin 178 is disposed below the pivot point 154 of the detent 150, and above the pivot point 170 of the tertiary catch 166.

Figure 15:
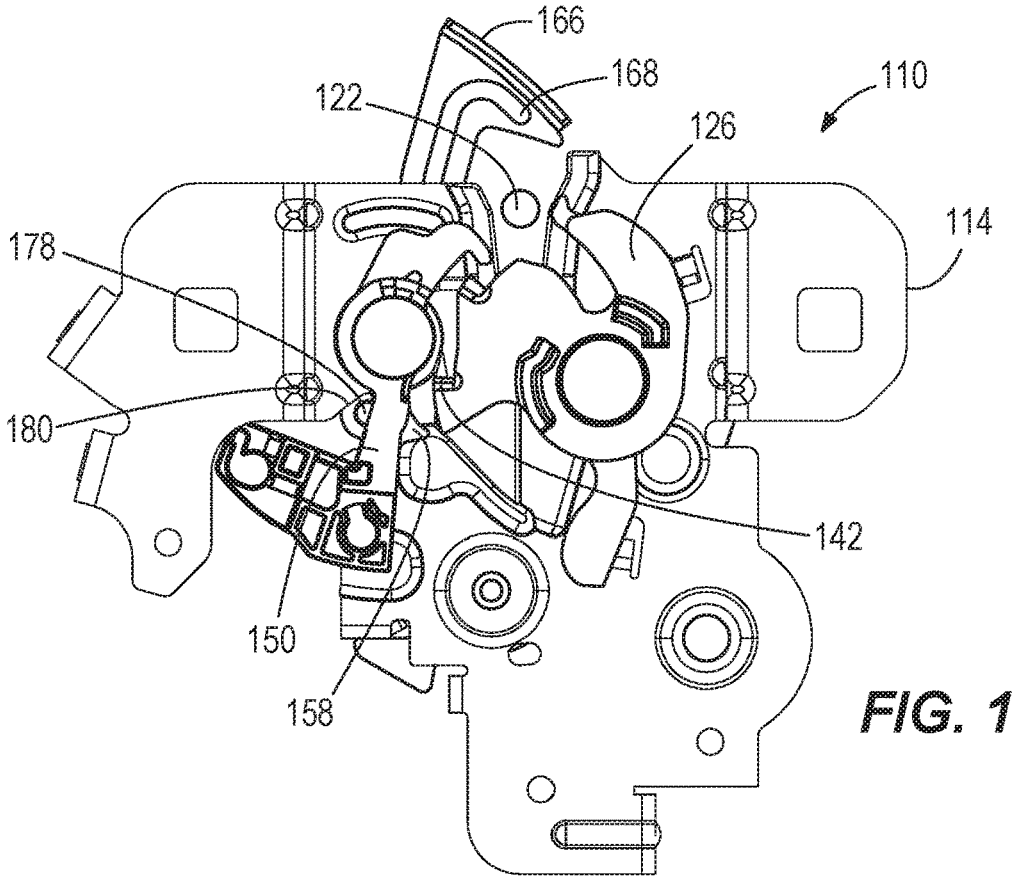
Figure 16:
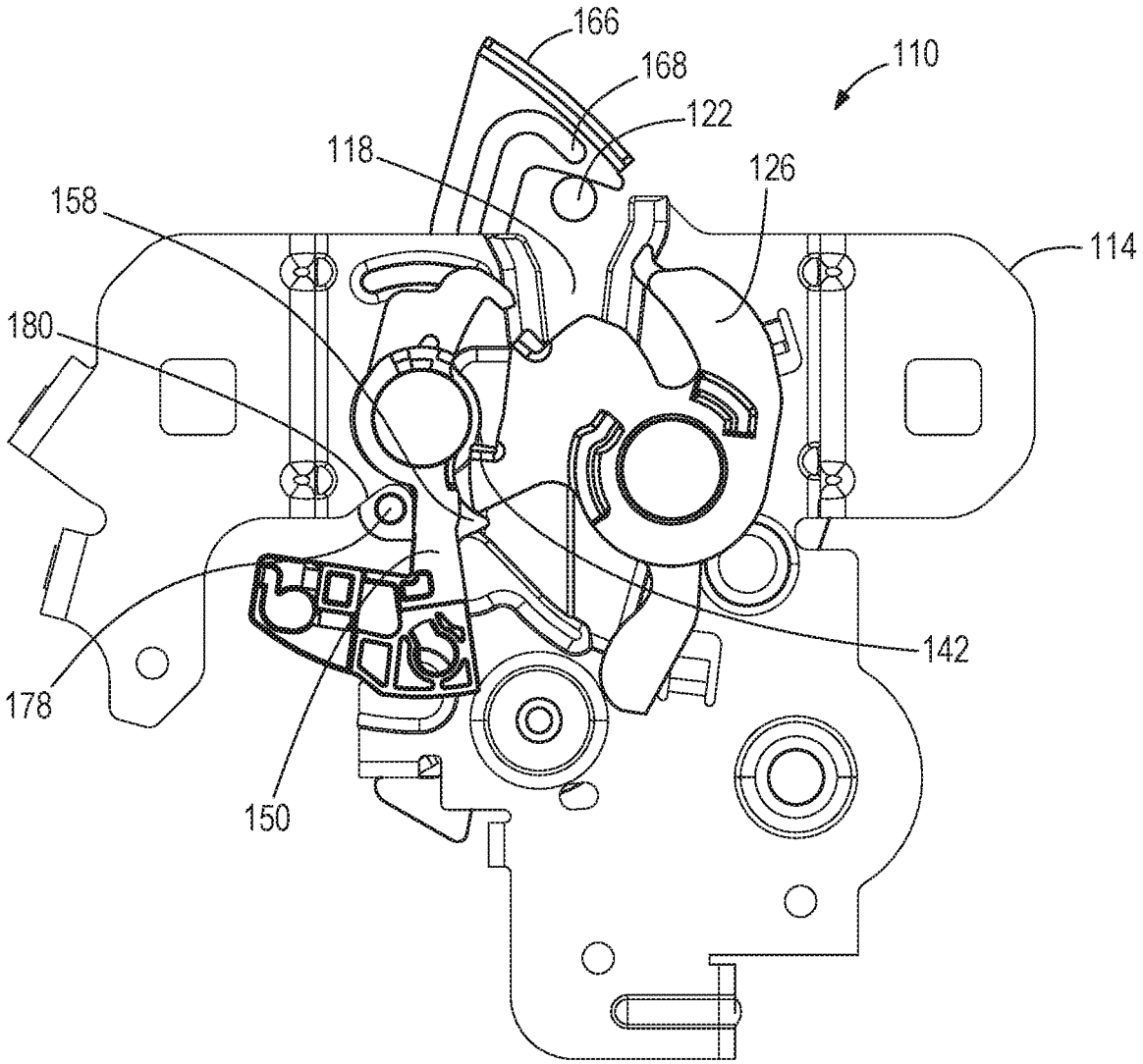
Figure 17:
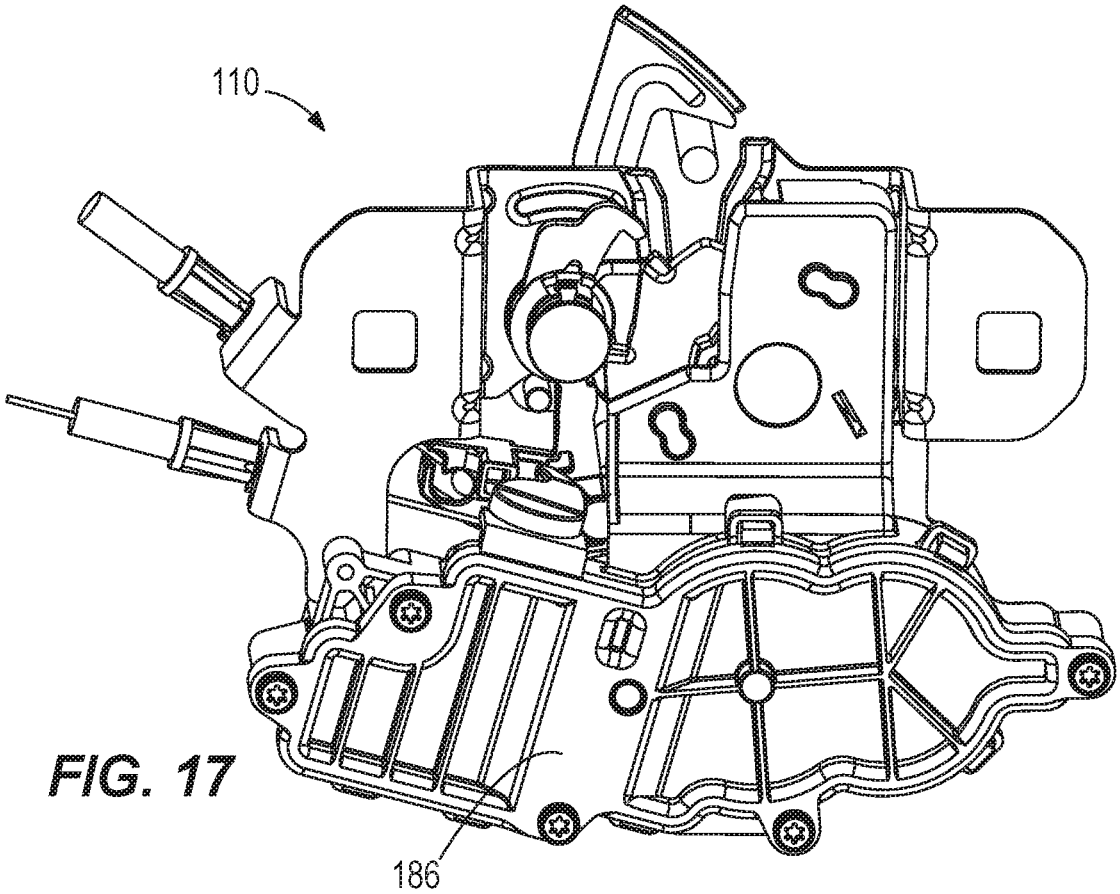
FIGS. 17 and 18 illustrate the latch assembly of FIGS. 12-16, having an integrated actuator.
Figure 19:
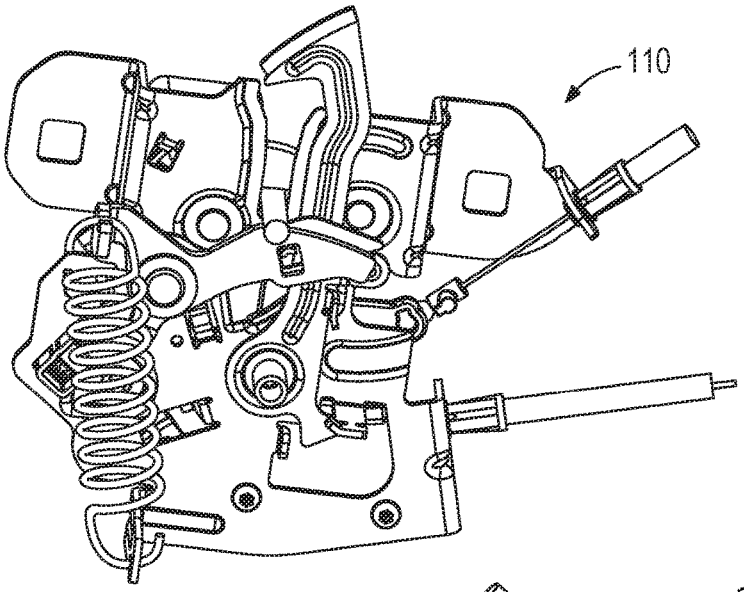
FIGS. 19-21 illustrate the latch assembly of FIGS. 12-16, having a remote actuator.
Figure 20:
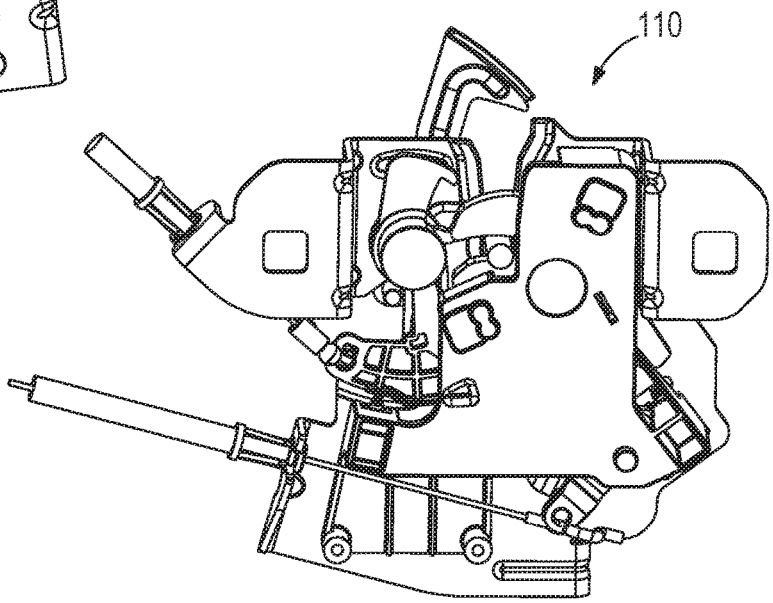
Figure 21:
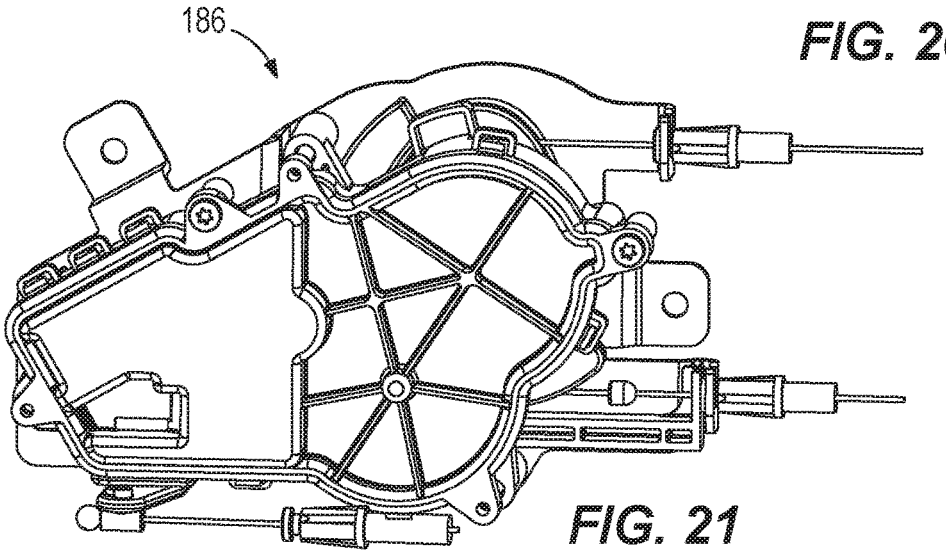

With continued reference to FIGS. 12-21, the latch assembly 10 further includes an actuator 186 (FIGS. 12, 17, 18, and 21) coupled to the detent 150. The actuator 186 acts to rotate the detent 150 about the pivot point 154. The actuator 186 may be a physical structure, such as a cable or rod, that is disposed within the vehicle (e.g., adjacent the driver seat) and that may be pulled (e.g., with a handle) by the driver. In some embodiments the actuator 186 is instead a motor (e.g., electric motor) that when activated rotates the detent 150. With reference to FIGS. 17 and 18, in some embodiments the actuator 186 is integrated with the latch assembly 110. With reference to FIGS. 19-21, in other embodiments at least a portion of the actuator 186 may be disposed remotely from the detent 150. In some embodiments, the actuator 186 may be disposed on the detent 150 itself or directly adjacent the detent 150.

In the illustrated embodiment, and with reference to FIG. 12, the actuator 186 is controlled via a controller 190 (similar to controller 90 described above). The controller 190 may be located on the vehicle, or may be a keyfob or other handheld device that is used by the driver to control activation of the actuator 186 and to control movement of the detent 150. In some embodiments, the controller 190 may be a button or other device disposed within the frunk itself in the event someone is entrapped in the frunk and needs to release the striker 122 to allow the hood to open.

With reference to FIGS. 12-16, the latch assembly 110 may be operated and moved into various positions during use. For example, with reference to FIG. 12, in a primary position the forkbolt 126 is rotated in a counterclockwise direction and the detent 150 is rotated in a counterclockwise direction. The striker 122 is held by the main arm 134 within the fishmouth 118, and the detent latching projection 158 is disposed above and engaged with the forkbolt latching projection 138. The tertiary catch 166 is positioned such that the hook region 168 extends over the fishmouth 118.

Figure 13:
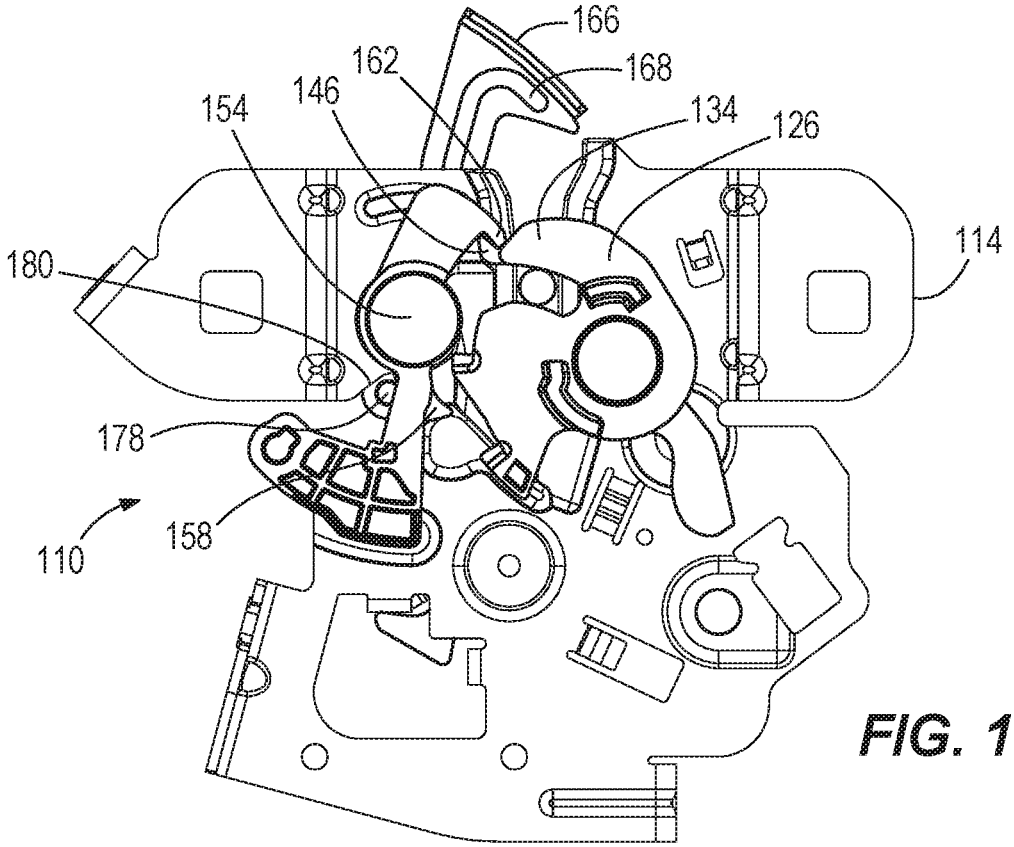

With reference to FIG. 13, the actuator 186 may be activated (e.g., via the controller 190) to pull on the detent 150 and rotate the detent 150 clockwise about the pivot point 154. This movement causes a release between the detent latching projection 158 and the forkbolt latching projection 138, allowing the forkbolt 126 to rotate clockwise.

As illustrated in FIG. 13, this movement brings the detent 150 close to, or adjacent the pin 178, without yet moving the pin 78. Thus, in contrast to the latch assembly 10 described above, in the latch assembly 110 the detent 150 first moves or rotates without pressing against the pin 178. This leaves the hook region 168 still positioned over the fishmouth 118. Only if the detent 150 is then rotated further will the pin 178 be contacted and moved, thereby sliding or otherwise moving the pin 178 within or along the notch 180 and rotating the tertiary catch 166 counterclockwise into a position where the hook region 168 is swung away from the fishmouth 118. This arrangement creates a delayed release timing for the hook region 168. In other words, the movement of the detent 150 and the tertiary catch 166 may be considered sequential, rather than simultaneous or parallel.

Figure 14:
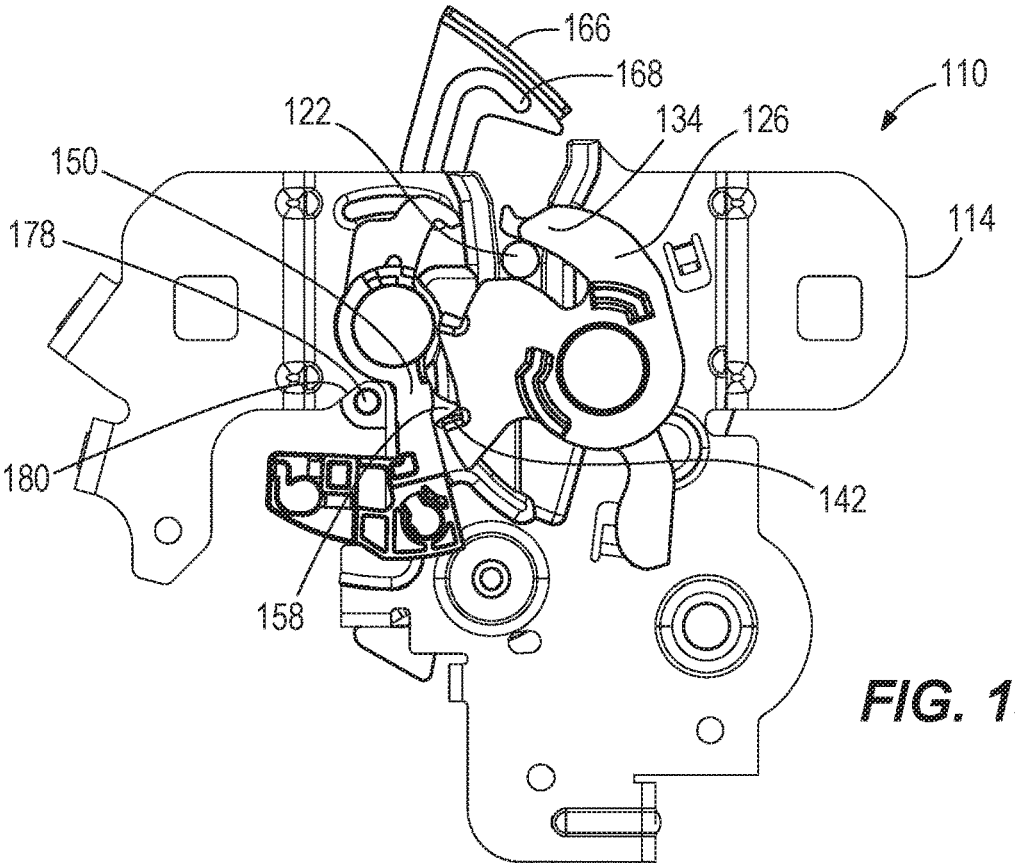

With reference to FIG. 14, once the actuator 186 is released or deactivated, the detent 150 then rotates back in a counterclockwise direction. In this position, the striker 122 is still retained by the main arm 134. Additionally, in the event the detent 150 was not rotated far enough to push the pin 178, the hook 168 remains over the fishmouth 118.

With reference to FIG. 15, the actuator 186 may then be activated a second time. When the actuator 186 is activated, the detent 150 is again pulled and rotated in a clockwise direction. This release allows the forkbolt 126 to again rotate clockwise as viewed in FIG. 15, until the striker 122 is no longer retained by the main arm 134 of the forkbolt 126. In some embodiments a pop-up mechanism (e.g., lever, spring, etc.) is provided that further aids in "popping up" the striker 122. As illustrated in FIG. 15, in this position the hook portion 168 of the tertiary catch1 66 may again still be over the fishmouth 118.

With reference to FIG. 16, the detent 150 may then be allowed to rotate back in a counterclockwise direction. As illustrated in FIG. 16, the hook portion 168 may block vertical movement of the striker 122.

Similar to the latch assembly 10, the movement of the tertiary catch 166 may be controlled based on a parking status of the vehicle, a vehicle speed, a timeout, a striker position, and/or a hood position. For example, if it is detected the vehicle is moving, or that the vehicle is moving at a predetermined speed, it may not be desirable for the hood to fly open, blocking the view of the driver. Therefore, the tertiary catch 166 may be held in the position illustrated in FIG. 16. Alternatively, if it is desired for the hood to be opened, the tertiary catch 166 may be moved for example by rotating the detent 150 a sufficient amount until the pin 178 is contacted and the tertiary catch 166 and its hook portion 168 are rotated away from the fishmouth 118.

Although the invention has been described in detail with reference to certain preferred embodiments, variations and modifications exist within the scope and spirit of one or more independent aspects of the invention as described.

What is claimed is:

1. A latch assembly comprising:

a support structure having a body defining a fishmouth;

a forkbolt coupled to the support structure and biased by a first biasing element to rotate in a first direction about a first pivot point, wherein the forkbolt is configured to engage and restrain a striker;

a detent coupled to the support structure and biased by a second biasing element to rotate in a second direction about a second pivot point, the detent configured to engage with the forkbolt in both a primary latched position and in a different, secondary latched position;

a tertiary catch coupled to the support structure and biased by a third biasing element to rotate in the first direction about a third pivot point, wherein the detent is configured to engage a portion of the tertiary catch and rotate the tertiary catch when the detent is rotated in the first direction; and an actuator coupled to the detent, wherein when the detent and the forkbolt are in the primary latched position, the actuator is configured to be activated a first time to cause the detent to rotate in the first direction and release from the forkbolt, and then deactivated a first time to cause the detent to rotate back in the second direction and re-engage the forkbolt in the secondary latched position, and wherein when the detent and the forkbolt are in the secondary latched position, the actuator is configured to be activated a second time to cause the detent to again rotate in the first direction and release from the forkbolt, thereby releasing the striker from the forkbolt, wherein the forkbolt, the detent, and the tertiary catch are arranged such that the striker is configured to be spaced from and out of contact with the tertiary catch in both the primary latched position and the secondary latched position;

wherein the forkbolt, the detent, and the tertiary catch are arranged such that in an intermediate position, which occurs while the forkbolt and the detent are being moved from the primary latched position to the secondary latched position, the detent is configured to engage the tertiary catch to rotate the tertiary catch in the second direction away from the fishmouth a first time, and wherein the tertiary catch is configured to rotate back over the fishmouth a first time in the secondary latched position, when the detent reaches the secondary latched position;

wherein the forkbolt, the detent, and the tertiary catch are also arranged such that in a pop-up position, which occurs after the secondary latched position when the actuator is activated the second time, the detent is configured to engage the tertiary catch to rotate the tertiary catch in the second direction away from the fishmouth a second time, and wherein the tertiary catch is configured to then rotate back over the fishmouth a second time to engage the striker after the pop-up position.

2. The latch assembly of claim 1, wherein the tertiary catch includes a hook region configured to extend over the fishmouth in both the primary latched position and the secondary latched position, wherein the hook region is configured to be spaced above the striker in both the primary latched position and the secondary latched position.

3. The latch assembly of claim 1, wherein the second biasing element is identical to the third biasing element.

4. The latch assembly of claim 3, wherein the second biasing element is a spring wrapped about the third pivot point.

5. The latch assembly of claim 3, wherein the tertiary catch includes a pin, wherein the pin is disposed above the third pivot point and below the second pivot point, and wherein the detent is configured to engage and press against the pin when the detent is rotated in the first direction.

6. The latch assembly of claim 5, wherein the support structure is a housing that defines a slot, wherein the pin is slidably disposed within the slot, wherein the actuator is configured to rotate the detent until the detent engages the pin and moves the pin within the slot.

7. The latch assembly of claim 1, wherein the forkbolt includes a first forkbolt latching projection and a second forkbolt latching projection, wherein the detent includes a detent latching projection, wherein the detent latching projection and the first forkbolt latching projection are configured to be engaged in the primary latched position, and wherein the detent latching projection and the second forkbolt latching projection are configured to be engaged in the secondary latched position.

8. The latching assembly of claim 1, wherein the tertiary catch includes a hook region.

9. The latching assembly of claim 8, wherein the actuator is configured to be deactivated a second time to cause the hook region to rotate back over the fishmouth and to engage and block the striker.

10. The latching assembly of claim 1, wherein in the intermediate position a portion of the forkbolt is configured to engage a portion the detent to stop rotation of the forkbolt, and prevent the striker from being fully released.

11. The latching assembly of claim 10, wherein the portion of the forkbolt is a forkbolt stop projection, and wherein the portion of the detent is a detent stop projection.

12. A latch assembly comprising:

a support structure having a body defining a fishmouth;

a forkbolt coupled to the support structure and biased by a first biasing element to rotate in a first direction about a first pivot point, wherein the forkbolt is configured to engage and restrain a striker;

a detent coupled to the support structure and biased by a second biasing element to rotate in a second direction about a second pivot point, the detent configured to engage with the forkbolt in both a primary latched position and in a different, secondary latched position;

a tertiary catch coupled to the support structure and biased by a third biasing element to rotate about a third pivot point, wherein in a first position of the tertiary catch a region of the tertiary catch is positioned adjacent the fishmouth, and in a second position of the tertiary catch the region of the tertiary catch is positioned away from the fishmouth; and an actuator coupled to the detent, wherein when the detent and the forkbolt are in the primary latched position, the actuator is configured to be activated a first time to cause the detent to rotate in the first direction and release from the forkbolt, and then deactivated a first time to cause the detent to rotate back in the second direction and re-engage the forkbolt in the secondary latched position, and wherein when the detent and the forkbolt are in the secondary latched position, the actuator is configured to be activated a second time to cause the detent to again rotate in the first direction and release from the forkbolt, thereby releasing the striker from the forkbolt, wherein the forkbolt, the detent, and the tertiary catch are arranged such that the striker is configured to be spaced from and out of contact with the tertiary catch in both the primary latched position and the secondary latched position;

wherein the forkbolt, the detent, and the tertiary catch are arranged such that both when in an intermediate position, which is between the primary latched position and the secondary latched position, and also in a pop-up position, which occurs after the secondary latched position when the actuator is activated the second time, the detent is configured to engage the tertiary catch to rotate the tertiary catch away from the fishmouth.

13. The latch assembly of claim 12, further comprising the striker, wherein the striker is disposed within the fishmouth and is blocked by the region of the tertiary catch in the first position.

14. The latch assembly of claim 12, wherein the region of the tertiary catch is a hook region at an end of the tertiary catch.

15. The latch assembly of claim 12, wherein the tertiary catch is biased to rotate in the first direction.

16. The latch assembly of claim 15, wherein the second biasing element is identical to the third biasing element.

17. The latch assembly of claim 12, wherein the tertiary catch includes a pin, wherein the pin is disposed above the third pivot point and below the second pivot point, and wherein the detent is configured to engage and press against the pin when the detent is rotated in the first direction.

18. A method of operating a latch assembly, the latch assembly including a support structure having a body defining a fishmouth, a detent, a forkbolt, and a tertiary catch, wherein the forkbolt restrains a striker, the method comprising:

rotating the detent a first time to cause a first rotational movement of the forkbolt from a first latched position toward a second latched position;

rotating the detent a second time to cause a second rotational movement of the forkbolt, wherein the second rotational movement releases the striker from the forkbolt;

wherein the step of rotating the detent the first time causes the detent to rotate the tertiary catch away from the fishmouth during the first rotational movement;

wherein after the first rotational movement, the tertiary catch is configured to rotate back over the fishmouth;

wherein the step of rotating the detent the second time causes the detent to rotate the tertiary catch away from the fishmouth during a pop-up position; and wherein after the pop-up position, the tertiary catch is configured to rotate back over the fishmouth to re-secure the striker and restrain the striker from further movement away from the latch assembly.

19. The method of claim 18, wherein the step of rotating the tertiary catch away from the fishmouth includes engaging the detent against a pin of the tertiary catch to move the pin and cause a rotational movement of the tertiary catch.

20. The method of claim 19, wherein the detent, the forkbolt, and the tertiary catch are each at least partially disposed within a housing, wherein the housing includes a slot, and wherein the step of rotating the tertiary catch away from the fishmouth includes sliding the pin within the slot.

21. The method of claim 18, wherein latch assembly includes a housing defining a fishmouth, and wherein the step of rotating the tertiary catch back over the fishmouth includes rotating a hook region of the tertiary catch over the fishmouth.

22. The method of claim 18, wherein the step of rotating the detent a first time includes sending a signal to an actuator to rotate the detent about a first pivot point, and wherein rotation of the detent about the first pivot point causes rotation of the tertiary catch about a separate pivot point.

23. The method of claim 18, wherein the detent, the forkbolt, and the tertiary catch are each spring-biased.

24. The method of claim 23, wherein the detent is biased in a first direction, and the forkbolt and the tertiary catch are each biased in a second, different direction.

* * * * *